US012385666B2

(12) United States Patent
Hyon et al.

(10) Patent No.: US 12,385,666 B2
(45) Date of Patent: Aug. 12, 2025

(54) AIR-PROCESSING APPARATUS

(71) Applicant: LG ELECTRONICS INC., Seoul (KR)

(72) Inventors: Chinsoo Hyon, Seoul (KR); Sehwan Bae, Seoul (KR); Heejae Kwon, Seoul (KR); Jeeyoung Yeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 487 days.

(21) Appl. No.: 17/742,758

(22) Filed: May 12, 2022

(65) Prior Publication Data

US 2022/0373223 A1 Nov. 24, 2022

(30) Foreign Application Priority Data

May 24, 2021 (KR) ..... 10-2021-0065987
May 24, 2021 (KR) ..... 10-2021-0065990
Dec. 7, 2021 (KR) ..... 10-2021-0174217

(51) Int. Cl.
*F24F 13/14* (2006.01)
*F24F 1/0011* (2019.01)

(52) U.S. Cl.
CPC ..... *F24F 13/1426* (2013.01); *F24F 1/0011* (2013.01); *F24F 2013/1433* (2013.01); *F24F 2013/1446* (2013.01)

(58) Field of Classification Search
CPC ..... F24F 13/1426; F24F 13/14; F24F 13/15; F24F 13/06; F24F 13/28; F24F 1/0011;
(Continued)

(56) References Cited

U.S. PATENT DOCUMENTS 3,618,659 A 11/1971 Rawal
4,203,566 A * 5/1980 Lord ..... B64D 13/00 165/41
(Continued)

FOREIGN PATENT DOCUMENTS

CN 2442167 8/2001
CN 1707169 12/2005
(Continued)

OTHER PUBLICATIONS

European Search Report dated Oct. 14, 2022 issued in EP Application No. 22173504.6.
(Continued)

*Primary Examiner* — Steven B McAllister
*Assistant Examiner* — Charles R Brawner
(74) *Attorney, Agent, or Firm* — KED & ASSOCIATES

(57) ABSTRACT

An air-processing apparatus is provided. The air-processing apparatus may include a case having an outlet formed therein, a louver rotatably disposed in the case and configured to adjust a direction of air flowing through the outlet, and a louver actuator configured to adjust an orientation of the louver. The louver may include a louver rotational shaft and a plurality of vanes spaced apart from each other in a radial direction based on the louver rotational shaft. The louver actuator may be disposed so as to be in contact with a vane located at an outermost position among the plurality of vanes to change an orientation of the louver.

16 Claims, 37 Drawing Sheets

(58) Field of Classification Search
CPC ..... F24F 2013/1433; F24F 2013/1466; F24F 8/108
USPC ..... 454/313
See application file for complete search history.

(56) References Cited

U.S. PATENT DOCUMENTS

| | | | | |
|---|---|---|---|---|
| 4,610,196 | A | 9/1986 | Kern | |
| 5,564,626 | A | 10/1996 | Kettler et al. | |
| 5,595,068 | A | 1/1997 | Amr | |
| 5,674,124 | A * | 10/1997 | Davis | F24F 13/08 454/316 |
| 5,697,841 | A * | 12/1997 | Di Giovine | F24F 13/065 454/307 |
| 6,974,377 | B2 * | 12/2005 | Gehring | F24F 13/06 454/154 |
| 8,343,244 | B2 | 1/2013 | Sakashita | |
| 10,989,429 | B2 | 4/2021 | Okamoto et al. | |
| 12,134,058 | B2 | 11/2024 | Hyon et al. | |
| 2002/0189274 | A1 | 12/2002 | Lee et al. | |
| 2006/0032260 | A1 | 2/2006 | Kang | |
| 2010/0040457 | A1 | 2/2010 | Tsen | |
| 2011/0143899 | A1 | 6/2011 | Wirth et al. | |
| 2012/0137876 | A1 | 6/2012 | Miller | |
| 2012/0151885 | A1 | 6/2012 | Nishihata et al. | |
| 2014/0026525 | A1 | 1/2014 | Miller | |
| 2014/0131026 | A1* | 5/2014 | Hurd | B60H 1/00842 165/204 |
| 2017/0191677 | A1 | 7/2017 | Jeong et al. | |
| 2018/0017282 | A1 | 1/2018 | Liu et al. | |
| 2018/0017284 | A1 | 1/2018 | Oishi et al. | |
| 2019/0041083 | A1 | 2/2019 | Kojima et al. | |
| 2019/0049137 | A1 | 2/2019 | Kojima et al. | |
| 2019/0056120 | A1* | 2/2019 | Cho | F24F 13/14 |
| 2019/0199960 | A1 | 6/2019 | Miyazaki | |
| 2019/0219277 | A1* | 7/2019 | Kim | F24F 11/79 |
| 2019/0275455 | A1 | 9/2019 | Choi et al. | |

FOREIGN PATENT DOCUMENTS

| | | |
|---|---|---|
| CN | 101048621 | 10/2007 |
| CN | 101178199 | 5/2008 |
| CN | 101370676 | 2/2009 |
| CN | 102460031 | 5/2012 |
| CN | 102563758 | 7/2012 |
| CN | 102607111 | 7/2012 |
| CN | 202747532 | 2/2013 |
| CN | 206682042 | 11/2017 |
| CN | 108180547 | 6/2018 |
| CN | 108387133 | 8/2018 |
| CN | 109790998 | 5/2019 |
| CN | 110332611 | 10/2019 |
| CN | 209763287 | 12/2019 |
| CN | 210050921 | 2/2020 |
| CN | 107250683 | 4/2020 |
| CN | 210463497 | 5/2020 |
| CN | 111637508 | 9/2020 |
| CN | 211977205 | 11/2020 |
| DE | 20 2007 001 644 | 7/2007 |
| DE | 10 2018 219 702 | 5/2020 |
| EP | 1 271 065 | 1/2003 |
| EP | 2 058 602 | 5/2009 |
| EP | 2 381 182 | 10/2011 |
| EP | 2 426 429 | 3/2012 |
| EP | 2725306 | 4/2014 |
| EP | 2 881 273 | 6/2015 |
| EP | 3 406 980 | 11/2018 |
| EP | 3 690 328 | 8/2020 |
| JP | H06-106967 | 4/1994 |
| JP | H06-147531 | 5/1994 |
| JP | H07-225046 | 8/1995 |
| JP | 08-05091 | 1/1996 |
| JP | H08-226668 | 9/1996 |
| JP | 08-270978 | 10/1996 |
| JP | 2001-263788 | 9/2001 |
| JP | 2003-148763 | 5/2003 |
| JP | 2004-101094 | 4/2004 |
| JP | 2005-172261 | 6/2005 |
| JP | 2005-214429 | 8/2005 |
| JP | 2006-145192 | 6/2006 |
| JP | 2006-162217 | 6/2006 |
| JP | 2007-024345 | 2/2007 |
| JP | 2008-039293 | 2/2008 |
| JP | 2008-069985 | 3/2008 |
| JP | 2008-122055 | 5/2008 |
| JP | 2008-133973 | 6/2008 |
| JP | 2008-164190 | 7/2008 |
| JP | 2008-224133 | 9/2008 |
| JP | 2008-241054 | 10/2008 |
| JP | 2008-267795 | 11/2008 |
| JP | 2009-002602 | 1/2009 |
| JP | 2009-186077 | 8/2009 |
| JP | 2012-013392 | 1/2012 |
| JP | 2014-077599 | 5/2014 |
| JP | 2014-129954 | 7/2014 |
| JP | 2017-524119 | 8/2017 |
| JP | 2019-170863 | 10/2019 |
| KR | 10-1999-0068938 | 9/1999 |
| KR | 20-0164654 | 2/2000 |
| KR | 20-0184583 | 6/2000 |
| KR | 10-2003-0053864 | 7/2003 |
| KR | 10-2004-0056151 | 6/2004 |
| KR | 20-0380530 | 3/2005 |
| KR | 10-0487474 | 5/2005 |
| KR | 10-2005-0122523 | 12/2005 |
| KR | 10-2006-0119068 | 11/2006 |
| KR | 10-0787501 | 12/2007 |
| KR | 10-2008-0026287 | 3/2008 |
| KR | 10-2008-0058732 | 6/2008 |
| KR | 10-2008-0078199 | 8/2008 |
| KR | 10-2009-0017290 | 2/2009 |
| KR | 10-2009-0052609 | 5/2009 |
| KR | 10-2009-0081607 | 7/2009 |
| KR | 10-0921921 | 10/2009 |
| KR | 10-2010-0036919 | 4/2010 |
| KR | 10-2012-0034446 | 4/2012 |
| KR | 10-2013-0108749 | 10/2013 |
| KR | 10-2014-0056465 | 5/2014 |
| KR | 10-2015-0018201 | 2/2015 |
| KR | 10-2015-0086092 | 7/2015 |
| KR | 10-2017-0080102 | 7/2017 |
| KR | 10-2018-0066546 | 6/2018 |
| KR | 10-2018-0126217 | 11/2018 |
| KR | 10-2019-0106608 | 9/2019 |
| KR | 10-2019-0106684 | 9/2019 |
| KR | 10-2019-0107784 | 9/2019 |
| KR | 10-2111216 | 5/2020 |
| KR | 10-2020-0106401 | 9/2020 |
| KR | 10-2020-144534 | 12/2020 |
| KR | 10-2021-0005979 | 1/2021 |
| KR | 10-2021-0005980 | 1/2021 |
| KR | 10-2021-0007010 | 1/2021 |
| RU | 2 347 149 | 12/2007 |
| WO | WO 2004/070283 | 8/2004 |
| WO | WO 2004/079271 | 9/2004 |
| WO | WO 2006/043430 | 4/2006 |
| WO | WO 2010/047443 | 4/2010 |
| WO | WO 2011/043123 | 4/2011 |
| WO | WO 2016/121071 | 8/2016 |
| WO | WO 2019/167313 | 9/2019 |
| WO | WO 2021/053985 | 3/2021 |

OTHER PUBLICATIONS

Korean Office Action dated Oct. 18, 2022 issued in KR Application No. 10-2021-0065984.

Korean Office Action dated Oct. 18, 2022 issued in KR Application No. 10-2021-0065986.

European Search Report dated Oct. 21, 2022 issued in EP Application No. 22173436.1.

Korean Office Action dated Apr. 14, 2023 issued in Application No. 10-2021-0065985.

(56) References Cited

OTHER PUBLICATIONS

U.S. Office Action issued in U.S. Appl. No. 17/742,706 dated Jan. 9, 2024.
India Office Action dated Dec. 9, 2022 issued in IN Application No. 202214012610.
European Search Report dated Oct. 13, 2022 issued in EP Application No. 22173411.4.
Korean Office Action issued in Application No. 10-2021-0174217 dated Mar. 10, 2023.
Korean Office Action issued in Application No. 10-2021-0174215 dated Mar. 10, 2023.
Korean Office Action issued in Application No. 10-2021-0174218 dated Mar. 20, 2023.
Chinese Office Action dated Jun. 3, 2024 issued in Application No. 202210557584.7.
India Office Action dated Nov. 29, 2022 issued in IN Application No. 202214012882.
Japanese Office Action issued in Application No. 2022-083486 dated Jun. 20, 2023.
Japanese Office Action issued in Application No. 2022-082791 dated Jun. 6, 2023.
Korean Notice of Allowance issued in Application No. 10-2021-0174218 dated Jul. 27, 2023.
Japanese Office Action issued in Application No. 2022-082832 dated May 30, 2023.
Korean Notice of Allowance issued in Application No. 10-2021-0174215 dated Jul. 27, 2023.
Korean Office Action dated Jul. 6, 2022 issued in Application No. 10-2021-0065983.
Japanese Office Action dated Jul. 4, 2023, issued in Application No. 2022-081386.
India Office Action dated Jan. 3, 2023 issued in IN Application No. 202214012884.
Korean Office Action dated Jan. 9, 2023 issued in KR Application No. 10-2021-0065989.
European Search Report dated Oct. 19, 2022 issued in EP Application No. 22173409.8.
European Search Report dated Oct. 28, 2022 issued in EP Application No. 22173423.9.
European Search Report dated Nov. 7, 2022 issued in EP Application No. 22173506.1.
India Office Action dated Nov. 29, 2022 issued in IN Application No. 202214012895.
India Office Action dated Dec. 1, 2022 issued in IN Application No. 202214012883.
India Office Action dated Dec. 6, 2022 issued in IN Application No. 202214012894.
Korean Office Action dated Jan. 9, 2023 issued in KR Application No. 10-2021-0065987.
U.S. Office Action dated Jan. 10, 2025, issued in U.S. Appl. No. 17/742,564.
Chinese Office Action dated Mar. 29, 2025, issued in Chinese Patent Application No. 202210557597.4.

* cited by examiner

AIR-PROCESSING APPARATUS

CROSS-REFERENCE TO RELATED APPLICATION(S)

This application claims priority under 35 U.S.C. § 119 to Korean Application Nos. 10-2021-0065987 and 10-2021-0065990 filed in Korea on May 24, 2021, and 10-2021-0174217 filed in Korea on Dec. 7, 2021, whose entire disclosures are hereby incorporated by reference.

BACKGROUND

1. Field

An air-processing apparatus, and more particularly, an air-processing apparatus including a louver configured to adjust a direction of air blown out through an outlet is disclosed herein.

2. Background

An air-processing apparatus may include an air conditioner configured to adjust an indoor temperature and an air purifier that removes fine dust from indoor air. In the case of an air conditioner, a stand-type indoor unit, a wall-mounted indoor unit, or a ceiling-mounted indoor unit may be mounted in an indoor space in order to adjust the temperature of the indoor space. An air purifier is generally configured to be movable, and is disposed on a floor of an indoor space in order to purify contaminated air in the indoor space.

Because an air conditioner and an air purifier are physically separated from each other and are located at different positions, a region in which the air conditioner discharges heat-exchanged air and a region in which the air purifier discharges purified air may differ from each other. In order to address this problem, a filter may be disposed in an inlet region of the air conditioner. However, when a high-efficiency particulate air (HEPA) filter for use in an air purifier is mounted in the air conditioner, the HEPA filter acts as resistance to a flow of air to a heat exchanger. Therefore, it is difficult to use a HEPA filter in an air conditioner.

Korean Patent Laid-Open Publication No. 10-2012-0034446, which is hereby incorporated by reference, discloses a structure in which a separate air conditioner is disposed in a lower space in a stand-type air conditioner. This structure enables individual air conditioning for a lower region and an upper region in an indoor space. However, it is difficult to perform air conditioning and air purification for overlapping regions.

A ceiling-mounted air-processing apparatus or a wall-mounted air-processing apparatus has an outlet formed to extend lengthwise in a lateral or leftward-rightward direction. In addition, this type of air-processing apparatus includes a louver that adjusts a direction of air blown out from the outlet formed in the leftward-rightward direction and a louver actuator that changes an orientation of the louver.

Korean Patent Laid-Open Publication No. 10-2018-0066546, which is hereby incorporated by reference, discloses an air-processing apparatus capable of adjusting the direction of air that is blown out by changing the orientation of a vane. However, a drive motor that changes the orientation of the vane is disposed on a left or right side of the vane, and thus, an outlet may not be formed in the portion in which the drive motor is disposed, which may cause a problem in which the area of the outlet is comparatively reduced.

BRIEF DESCRIPTION OF THE DRAWINGS

Embodiments will be described in detail with reference to the following drawings in which like reference numerals refer to like elements, and wherein.

DETAILED DESCRIPTION

Figure 1:
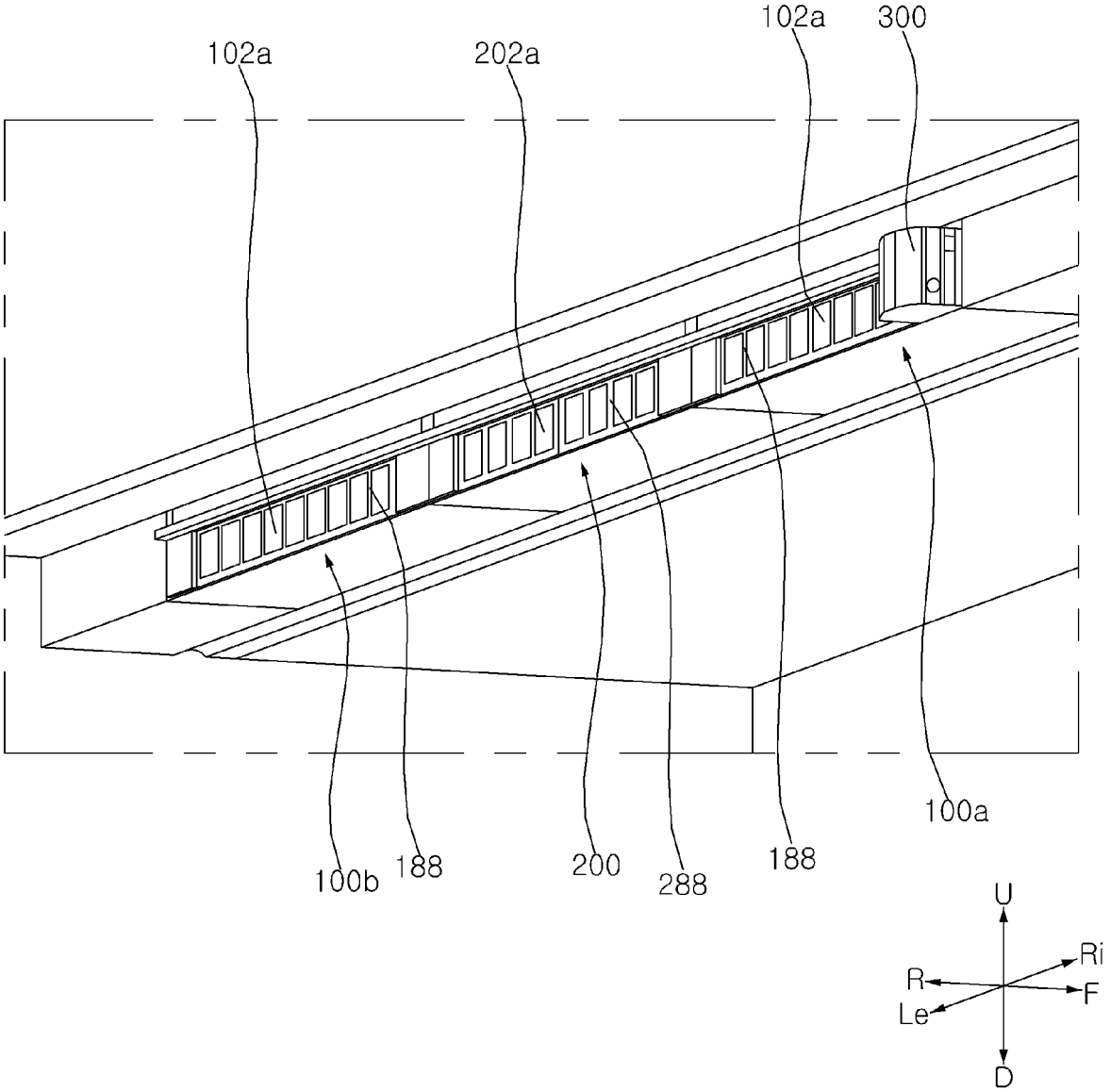
FIG. 1 is a perspective view of a first air-processing apparatus, a second air-processing apparatus, and a filter cleaner according to an embodiment disposed in an indoor space.

Advantages and features and methods for achieving them will be made clear from embodiments described below with reference to the accompanying drawings. The embodiments may, however, be embodied in many different forms, and should not be construed as being limited to the embodiments set forth herein. Rather, these embodiments are provided so that this disclosure will be thorough and complete, and will fully convey the scope to those skilled in the art. The embodiments are defined only by the scope of the claims. Throughout the specification, the same or like reference numerals represent the same or like components.

The terms "U", "D", "Le", "Ri", "F", and "R" shown in FIGS. 1 to 35C indicate an upward direction, a downward direction, a leftward direction, a rightward direction, a forward direction, and a rearward direction, respectively. The aforementioned directions are used only for convenience of description, and are not intended to limit the scope of the disclosure. Thus, the aforementioned directions may be set differently according to some reference.

Hereinafter, an air-conditioning system according to an embodiment will be described with reference to the accompanying drawings.

An air-conditioning system according to an embodiment may include a first air-processing apparatus 100, which adjusts a temperature of air through heat exchange between the air and a refrigerant, and a second air-processing apparatus 200, which is disposed on one side of the first air-processing apparatus in order to remove foreign substances from the air. The air-conditioning system according to an embodiment may include a plurality of air-processing apparatuses 100*a*, 100*b*, and 200. The air-conditioning system according to an embodiment may include one or two or more first air-processing apparatuses 100*a* and 100*b* and one or two or more second air-processing apparatuses 200.

The air-conditioning system according to an embodiment may include a filter cleaner 300, which moves along a surface in which inlets 102*a* and 202*a* of the plurality of air-processing apparatuses 100*a*, 100*b*, and 200 are formed in order to clean pre-filters 188 and 288 disposed in the inlets 102*a* and 202*a*.

Referring to FIG. 1, the air-conditioning system according to an embodiment may include one second air-processing apparatus 200 and two first air-processing apparatuses 100 disposed on both sides of the second air-processing apparatus 200. However, this is merely illustrative, and a numbers and arrangement of first and second air-processing apparatuses 100 and 200 may be set differently.

Figure 2:
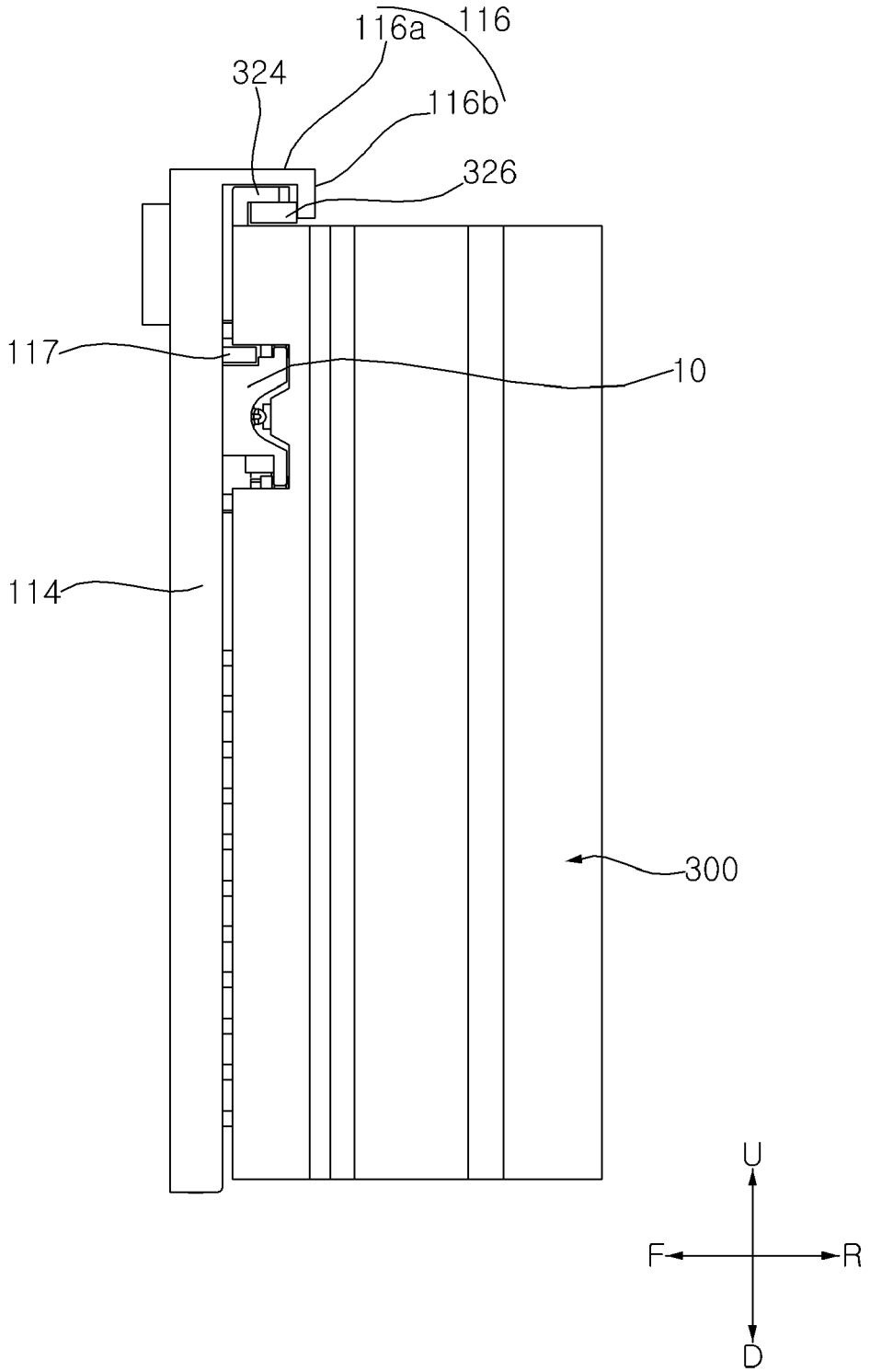
FIG. 2 is a side view for explaining a filter cleaner disposed behind a first air-processing apparatus or a second air-processing apparatus according to an embodiment.
Figure 3:
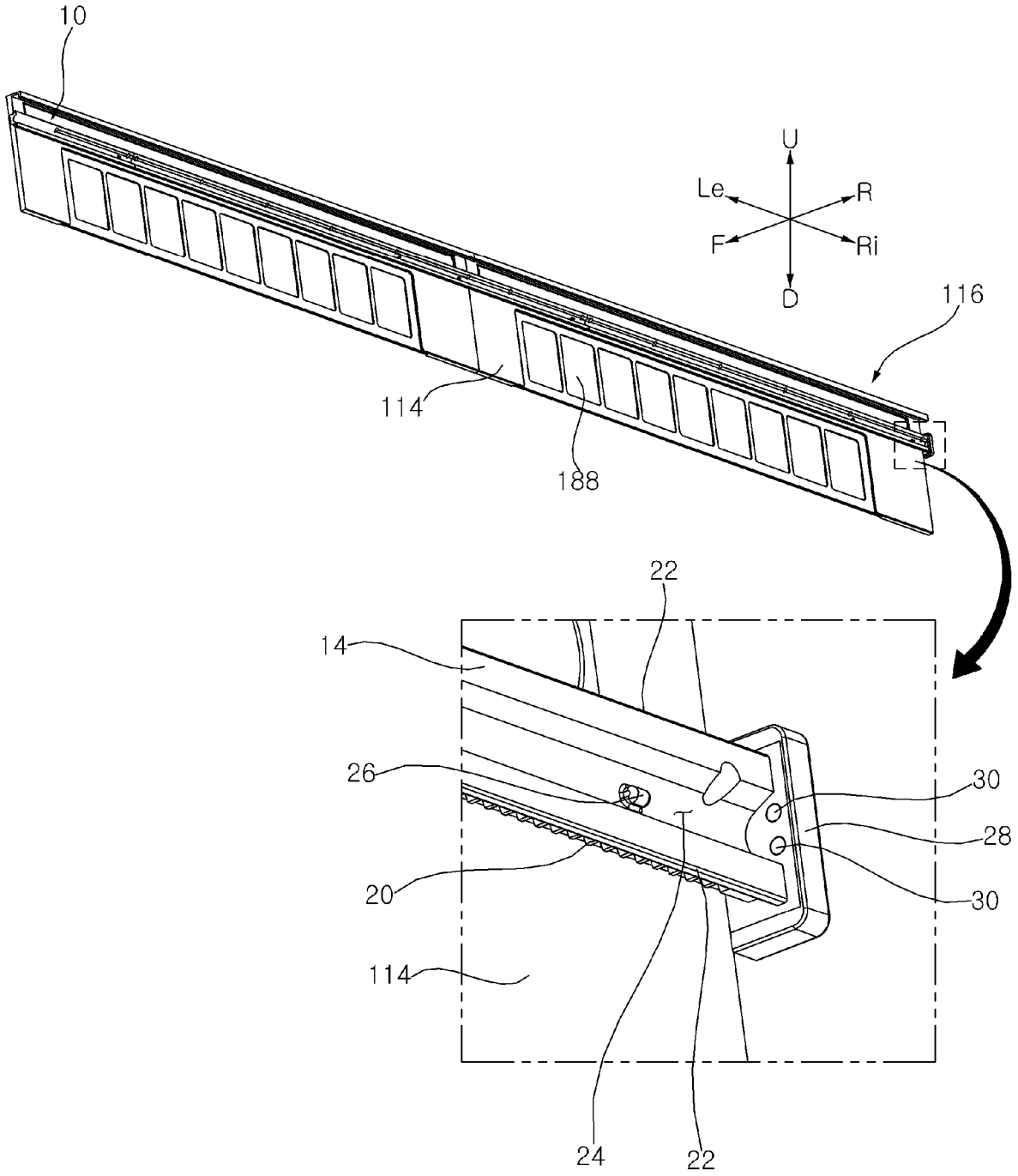
FIG. 3 is a perspective view for explaining a guide rail disposed behind a first air-processing apparatus and a second air-processing apparatus according to an embodiment.
Figure 4:
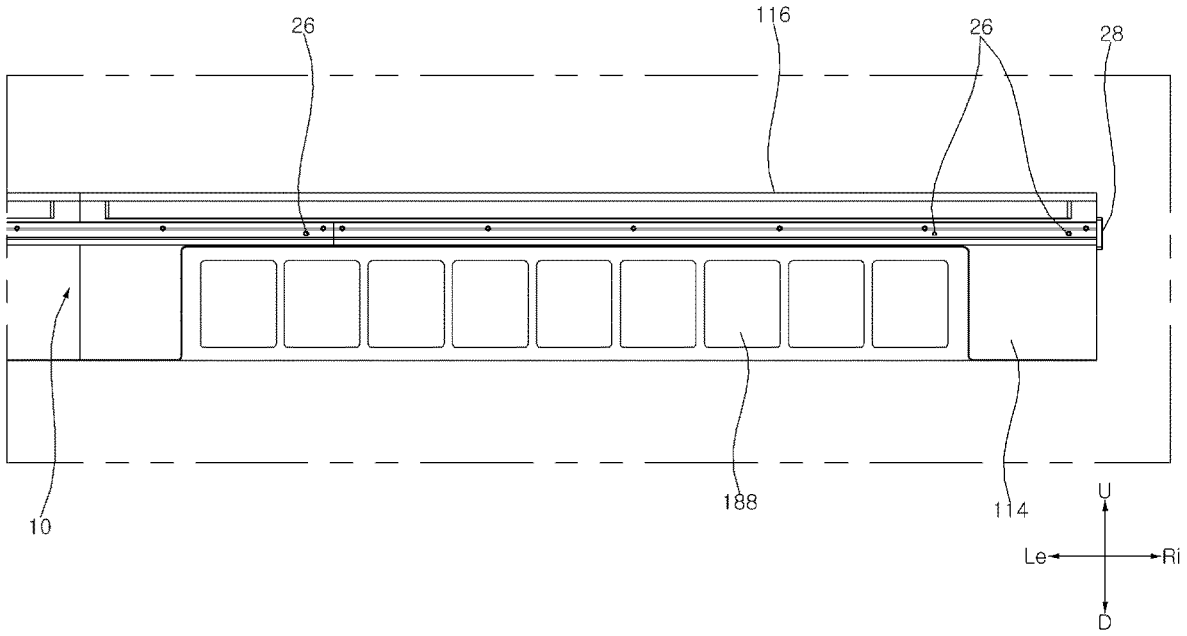
FIG. 4 is a rear view of the guide rail of FIG. 3.

Referring to FIG. 2, the air-conditioning system may include a guide rail 10, which is disposed at the rear sides of the first air-processing apparatuses 100 and the second air-processing apparatus 200 in order to guide movement of the filter cleaner 300. Support rails 116 and 244 that support movement of the filter cleaner 300 may be disposed at upper ends of rear surfaces of the first air-processing apparatuses 100 and the second air-processing apparatus 200.

The support rails may include first support rails 116 disposed at the first air-processing apparatuses 100 and second support rail 244 disposed at the second air-processing apparatus 200. The first support rails 116 may be formed integrally with first rear covers 114 (refer to FIG. 8) of the first air-processing apparatuses 100, which will be described hereinafter. The second support rail 244 may be formed integrally with a second rear cover 242 (refer to FIG. 20) of the second air-processing apparatus 200, which will be described hereinafter.

The guide rail 10 may be disposed on rear sides of the first rear covers 114 and the second rear cover 242. The guide rail 10 may be disposed above the first inlets 102*a* and the second inlet 202*a*. The guide rail 10 may extend in a lateral or leftward-rightward direction on the rear sides of the first rear covers 114 and the second rear cover 242. The guide rail 10 may be fixedly disposed below first rail-fixing protrusions 117 of the first rear covers 114 and a second rail-fixing protrusion 245 of the second rear cover 242.

The guide rail 10 may include a gear rail 20, which has threads to be engaged with a moving gear (not shown) of the filter cleaner 300, and a roller rail 22, which is in contact with a guide roller (not shown) of the filter cleaner 300.

The roller rail 22 may be disposed behind the gear rail 20. The roller rail 22 may be disposed at each of an upper side and a lower side of the guide rail 10. The gear rail 20 may be disposed in front of the roller rail 22. The gear rail 20 may be formed on a lower surface of the guide rail 10. The gear rail 20 may have a shape of a rack gear. When viewed from the rear, the guide rail 10 may have a structure in which the gear rail 20 is shielded by the roller rail 22.

A rail groove 24 may be formed in a rear surface of the guide rail 10. The rail groove 24 may be recessed in a forward direction and extend in the lateral direction. An object to be sensed 26 may be disposed in the rail groove 24. A plurality of the object to be sensed 26 may be provided, and the plurality of objects to be sensed may be spaced apart from each other in the lateral direction. A sensor (not shown) may be disposed at the filter cleaner 300, and when the sensor senses the object to be sensed 26, a position of the filter cleaner 300 may be detected.

The object to be sensed 26 may correspond to the sensor. For example, when the sensor is a switch sensor, the object to be sensed 26 may have a shape of a protrusion that protrudes rearwards. Alternatively, when the sensor is a Hall sensor, the object to be sensed 26 may be implemented as a magnet.

An end plate 28 configured to limit movement of the filter cleaner 300 in one direction may be disposed at a left end or a right end of the guide rail 10. The end plate 28 may extend in a direction perpendicular to a direction in which the guide rail 10 extends. The end plate 28 may protrude rearwards from the rear cover 114.

The end plate 28 may be provided with a charging terminal 30, with which a connection terminal 320 of the filter cleaner 300 is brought into contact. The charging terminal 30 protrudes from the end plate 28 in the direction in which the guide rail 10 extends. Accordingly, when the filter cleaner 300 reaches the end plate 28, the connection terminal 320 of the filter cleaner 300 may be brought into contact with and connected to the charging terminal 30.

Hereinafter, a first air-processing apparatus according to an embodiment will be described with reference to FIGS. 5 to 17C.

Figure 5:
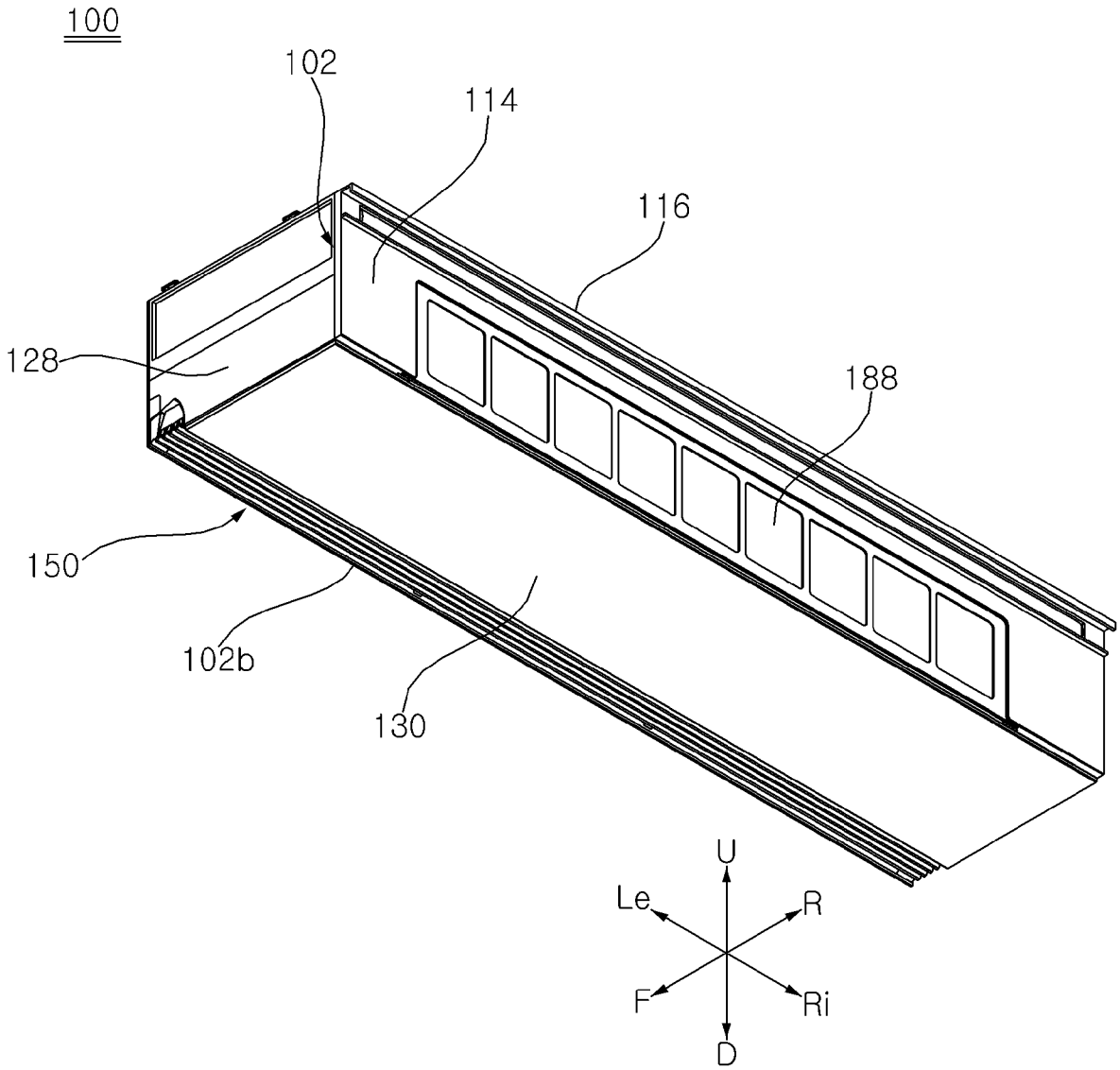
FIG. 5 is a perspective view of a first air-processing apparatus according to an embodiment.

The first air-processing apparatus 100 induces air to exchange heat with a refrigerant and discharges the heat-exchanged air to the outside. The first air-processing apparatus 100 may include first inlet 102*a* formed in one or a first side thereof in order to suction air thereinto and a first outlet 102*b* formed in another or a second side thereof perpendicular to the first inlet 102*a* in order to discharge air therefrom. Referring to FIG. 5, the first inlet 102*a* may be formed so as to be perpendicular to a surface of a floor or ceiling. The first outlet 102*b* may be open downwards. The first outlet 102*b* may extend perpendicular to the first inlet 102*a*.

Figure 6:
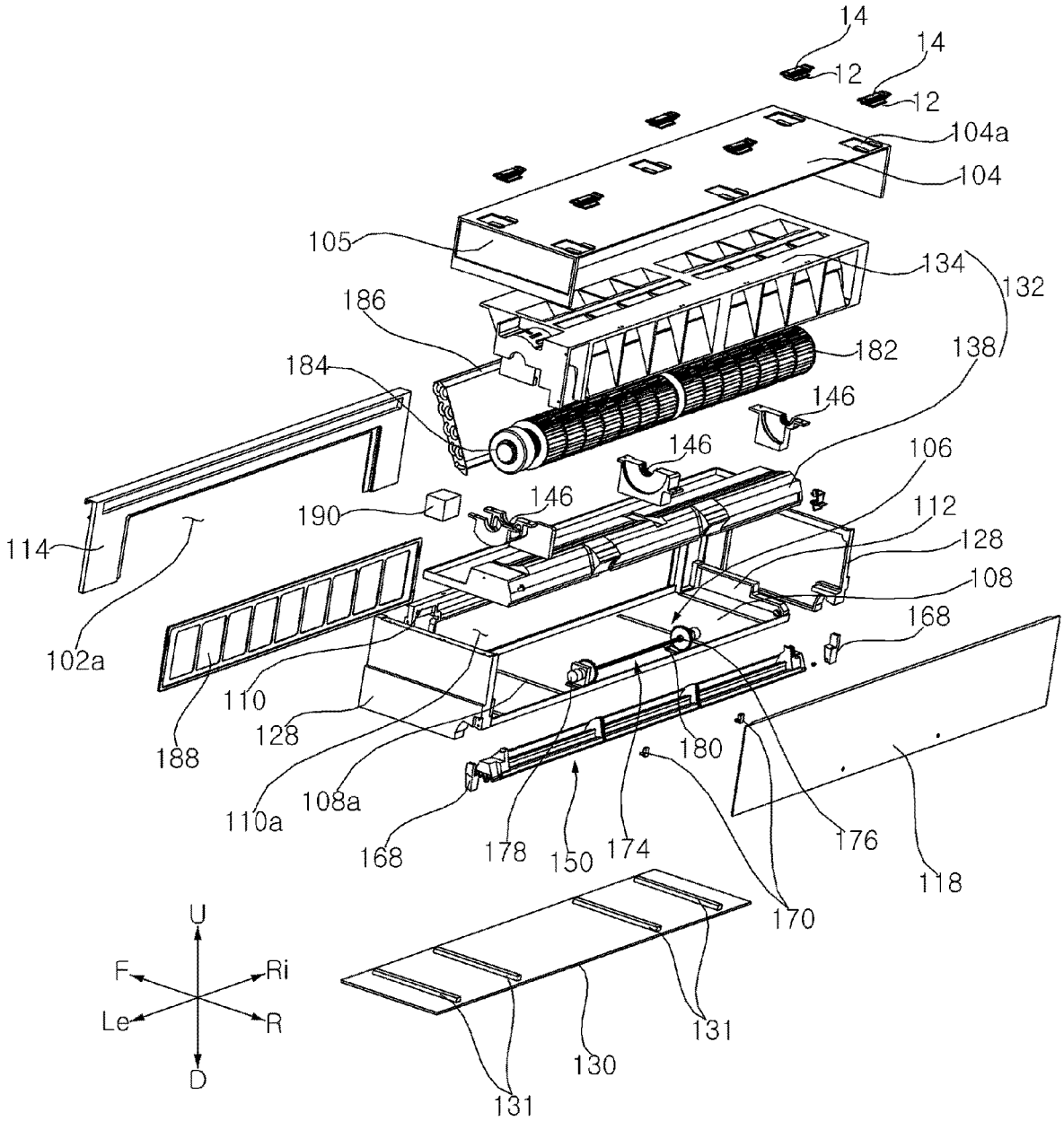
FIG. 6 is an exploded perspective view of the first air-processing apparatus of FIG. 5.
Figure 7:
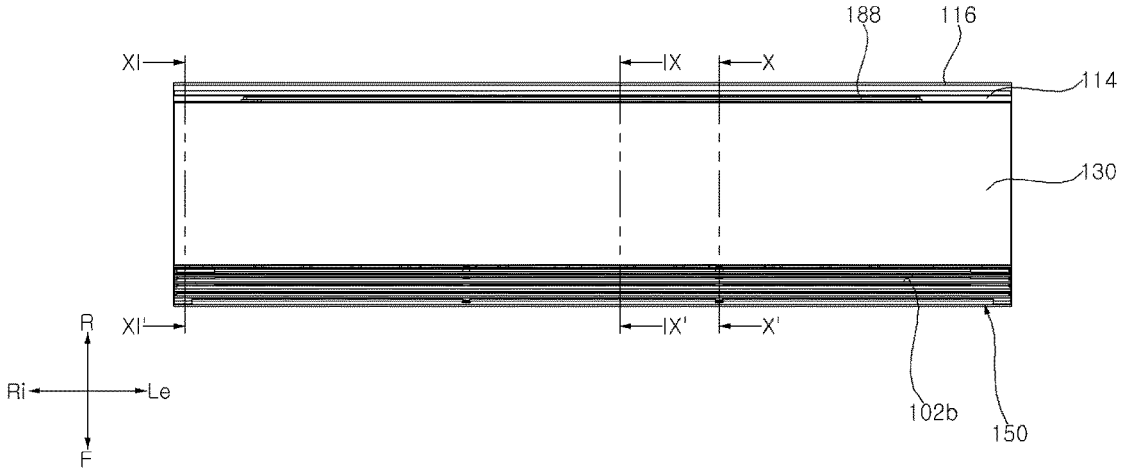
FIG. 7 is a bottom view of the first air-processing apparatus of FIG. 5.
Figure 8:
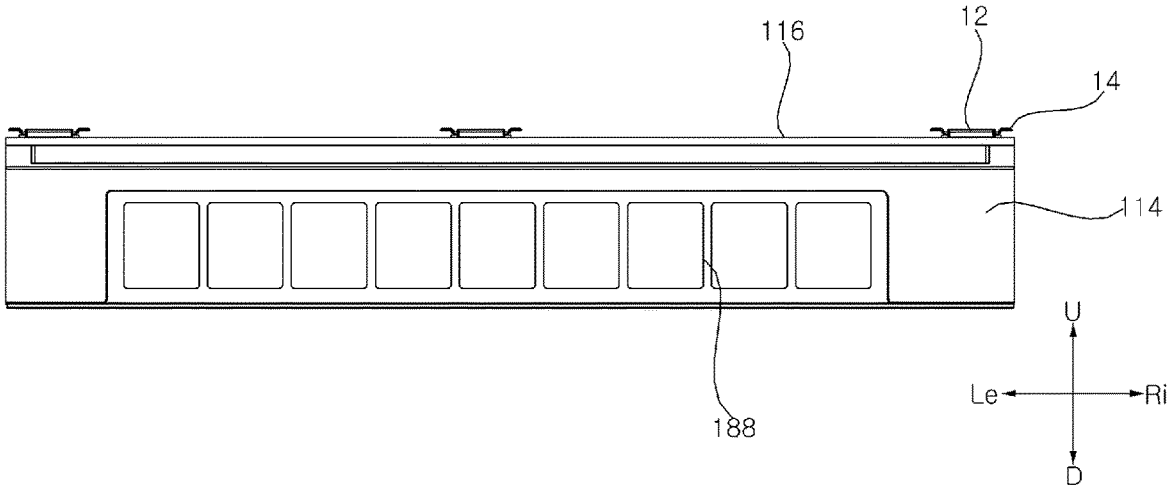
FIG. 8 is a rear view of the first air-processing apparatus of FIG. 5.

Referring to FIG. 6, the first air-processing apparatus 100 may include a first fan 182, which causes air to flow, a first fan motor 184, which rotates the first fan 182, and a heat exchanger 186, through which a refrigerant flows to exchange heat with air. The first air-processing apparatus 100 may further include a first case 102, which forms an external appearance of the first air-processing apparatus 100, and a first housing 132, which is disposed inside of the first case 102 and which forms a flow path through which air flows. The first air-processing apparatus 100 may further include a first louver 150, which is rotatably disposed in the first case 102 in order to adjust a direction of air that is discharged from the first outlet 102*b*, and a first louver actuator 174, which changes an orientation of the first louver 150. The first air-processing apparatus 100 may also include a first control box 190 that controls operation of the first fan motor 184 or operation of the first louver actuator 174.

Referring to FIG. 6, the first case 102 may include a first upper cover 104, which may be secured to a ceiling, a first lower cover 106, which is disposed below the first upper cover 104, a first rear cover 114, in which is formed therein the first inlet 102*a* and to which first pre-filter 188 is mounted, a first front cover 118, which is spaced forwards apart from the first rear cover 114, and two first side covers 128, which are disposed at both side ends of the first lower cover 106. Referring to FIG. 6, the first case 102 may further include a first bottom cover 130, which is disposed below the first lower cover 106.

Referring to FIG. 6, the first inlet 102*a* may be formed in the first rear cover 114. The guide rail 10 may be mounted on an outer surface of the first rear cover 114. The first inlet 102*a* may be formed in a lower portion of the first rear cover 114. The first pre-filter 188 may be mounted in the first inlet 102*a* formed in the first rear cover 114. The guide rail 10 and the first support rail 116 that guides movement of the filter cleaner 300 may be mounted on the first rear cover 114.

Referring to FIG. 2, the guide rail 10 may be disposed above the first inlet 102*a*. The first support rail 116 may be disposed at an upper end of the first rear cover 114. The guide rail 10 may be provided separately from the first rear cover 114. The first support rail 116 may be formed integrally with the first rear cover 114.

Figure 9:
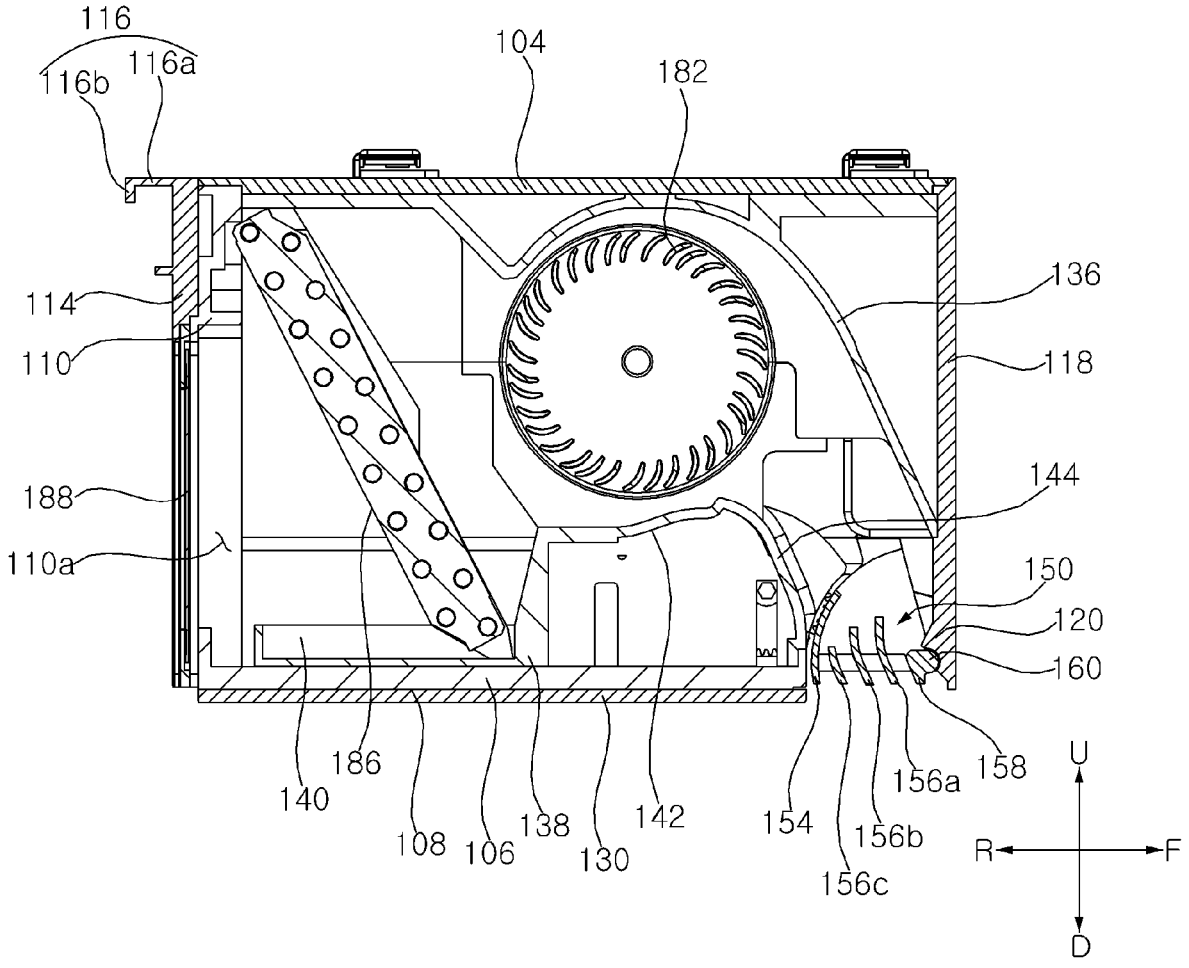
FIG. 9 is a cross-sectional view, taken along line IX-IX' in FIG. 7.

Referring to FIG. 9, the first support rail 116 may include a first top plate 116*a*, which protrudes rearwards from the upper end of the first rear cover 114, and a first bent portion 116*b*, which is bent and extends downwards from the rear end of the first top plate 116*a*. A top roller 326 (refer to FIG. 2) of the filter cleaner 300 may be in contact with the first bent portion 116*b*.

Referring to FIG. 9, the first rear cover 114 may be disposed behind a first vertical plate 110 of the first lower cover 106, which will be described hereinafter. The first rear cover 114 may be fixedly disposed behind the first vertical plate 110.

Referring to FIG. 6, the first upper cover 104 may include a first fixing recess 104*a* formed in an upper surface thereof, into which a fixing member 12 that fixes the first case 102 to the ceiling may be inserted. Referring to FIG. 6, a plurality of first fixing recesses 104*a* may be formed in the upper surface of the first upper cover 104. The fixing member 12 may be inserted into and fixed to each of the plurality of first fixing recesses 104*a*. The fixing member 12 may have a substantial "[" shape when viewed from the side. The fixing member 12 may be connected to a mounting member 14 that is fixed to the ceiling, thereby fixing the first case 102 to the ceiling.

The first upper cover 104 may include two side plates 105, which are bent and extend downwards from both side ends thereof. Each of the two side plates 105 may be connected to a respective one of the two first side covers 128.

Referring to FIG. 6, the first lower cover 106 may be disposed below the first housing 132. The first louver actuator 174 may be disposed on the first lower cover 106. The first lower cover 106 may include a first horizontal plate 108, which is disposed above the first bottom cover 130, first vertical plate 110, which is disposed at a rear side of the first horizontal plate 108 so as to be perpendicular thereto and in which a first inner suction hole 110*a* may be formed, and two first side walls 112, which are bent and extend upwards from both side ends of the first horizontal plate 108.

The first louver actuator 174 may be disposed on the first horizontal plate 108. The first horizontal plate 108 may include a connection slit 108*a* formed therein to allow a vertical protrusion 131 of the first bottom cover 130 to be inserted thereinto.

Referring to FIG. 6, each of the two first side covers 128 may be connected at a lower portion thereof to the first lower cover 106, and connected at an upper portion thereof to the first upper cover 104. A first rotational support rod 168 that supports rotation of the first louver 150 may be disposed on each of the two first side covers 128. The first rotational support rod 168 may be connected to each of both ends of the first louver 150, thereby supporting rotation of the first louver 150.

Referring to FIG. 9, the first front cover 118 may be disposed in front of the first housing 132. Referring to FIG. 9, a lower end of the first front cover 118 may be spaced a predetermined gap apart from a front end portion 106*a* of the first lower cover 106. The first outlet 102*b* may be formed between the first front cover 118 and the first lower cover 106. A first louver protrusion 120, in which a first louver groove 122 configured to receive a louver rotational shaft 160 is formed, may be formed on the first front cover 118 in order to limit a range within which the first louver 150 may rotate.

The first louver protrusion 120 may extend lengthwise in the lateral direction, in which the first front cover 118 is formed. Referring to FIG. 14B, the first louver protrusion 120 has the first louver groove 122 formed therein to allow the louver rotational shaft 160 of the first louver 150 to be disposed therein. The first louver groove 122 may extend lengthwise in the lateral direction, in which the first louver protrusion 120 extends.

Figure 14A:
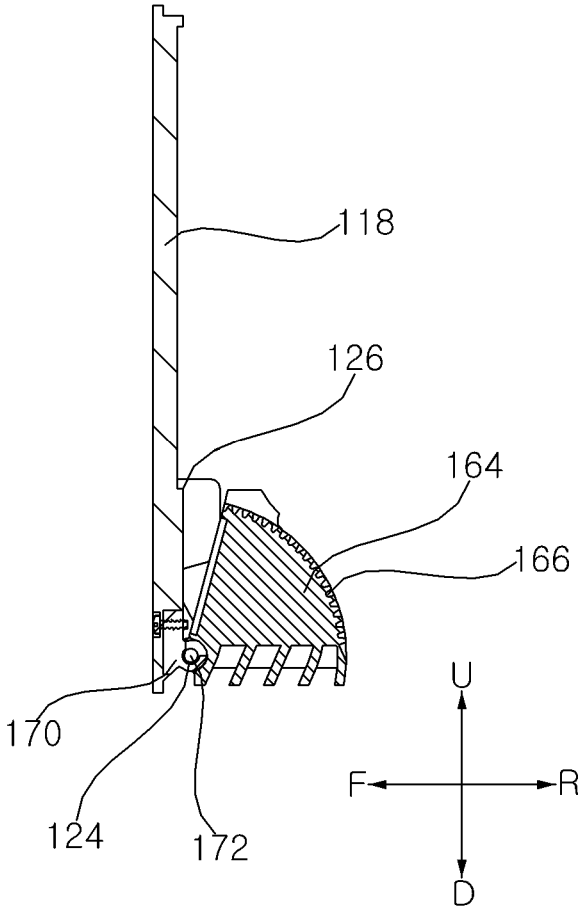
FIG. 14A is a cross-sectional view, taken along line XIVA-XIVA' in FIG. 13.
Figure 14B:
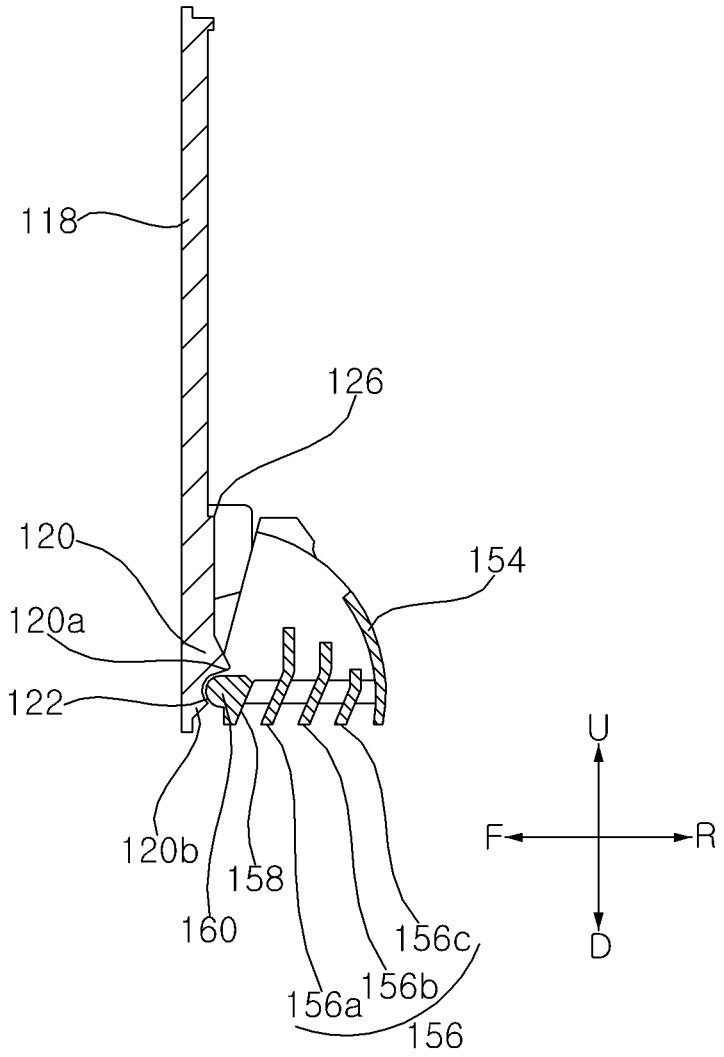
FIG. 14B is a cross-sectional view, taken along line XIVB-XIVB' in FIG. 13.
Figure 15:
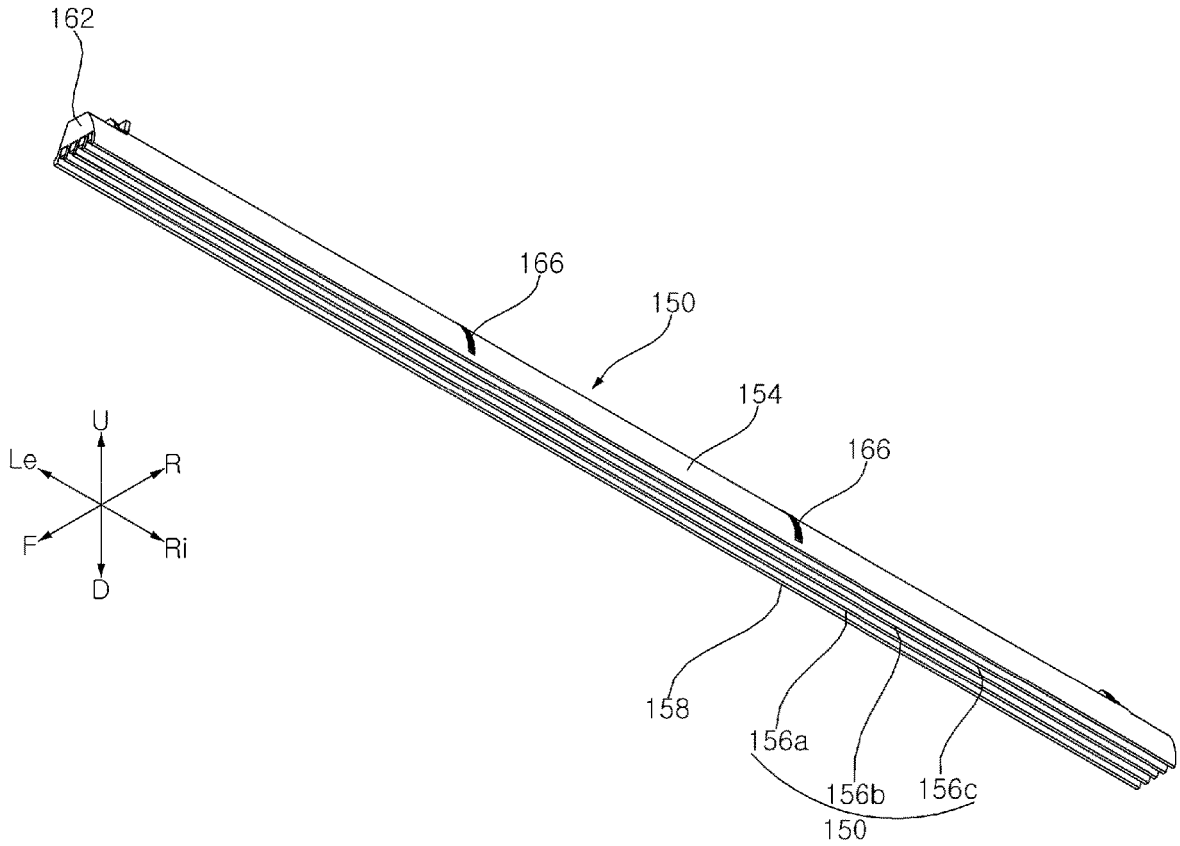
FIG. 15 is a perspective view of a louver according to an embodiment.

Referring to FIG. 14A, a first support-rod recess 124 in which a first auxiliary support rod 170 may be disposed is formed between a left or first end and a right or second end of the first louver protrusion 120. The first auxiliary support rod 170 may be fixedly disposed on the first front cover 118, and may support rotation of the first louver 150. The first auxiliary support rod 170 may be disposed between two first rotational support rods 168, which will be described hereinafter. The first auxiliary support rod 170 may be connected to the first louver 150 via a first auxiliary rotational shaft 172.

Referring to FIG. 14B, the first louver protrusion 120 may include an upper protruding portion 120*a*, which forms a surface that is inclined from an upper end of the first louver groove 122 in a rearward-upward direction, and a lower protruding portion 120*b*, which forms a surface that is inclined from a lower end of the first louver groove 122 in a forward-downward direction.

When the upper surface of the louver rotational shaft 160 of the first louver 150, which will be described hereinafter, comes into contact with the upper protruding portion 120*a*, rotation of the first louver 150 in one direction is limited by the upper protruding portion 120*a*. When an axial vane 158 of the first louver 150, which will be described hereinafter, comes into contact with the lower protruding portion 120*b*, rotation of the first louver 150 in the opposite direction is limited by the lower protruding portion 120*b*.

Referring to FIG. 14B, a first stepped portion or step 126, which interferes with an end portion of a first upper housing 134 described hereinafter, may be formed in the first front cover 118.

Referring to FIG. 9, the first housing 132 may be disposed inside of the first case 102, and form therein a space through which air flows. The first fan 182 and the heat exchanger 186 may be disposed inside of the first housing 132. Referring to FIG. 9, the heat exchanger 186 may be disposed in a region adjacent to the first inlet 102*a*. The heat exchanger 186 may be disposed so as to be inclined toward the first fan 182 to thereby increase a heat-exchange area and minimize resistance to air flow.

The first fan motor 184 that rotates the first fan 182 may be disposed inside of the first housing 132. The first fan motor 184 may be disposed on a rotational shaft of the first fan 182 in order to rotate the first fan 182. The first fan 182 may be implemented as, for example, a cross-flow fan, which is configured to suction air into one side thereof in a radial direction and to discharge air from another side thereof in the radial direction. Referring to FIG. 6, a fan support bracket 146 may be disposed inside of the first housing 132 in order to support rotation of the first fan 182 or to support placement of the first fan motor 184.

Referring to FIG. 6, the first housing 132 may include first upper housing 134, which is disposed above the first fan 182, and a first lower housing 138, which is disposed below the first fan 182. Referring to FIG. 9, the first upper housing 134 and the first lower housing 138 may form discharge guides 136 and 144, along which air flows from the first fan 182 to the first outlet 102*b*.

The first upper housing 134 may be mounted to the first upper cover 104. A lower end of the first upper housing 134 may be disposed at an upper side of the first stepped portion 126 of the first front cover 118. Referring to FIG. 9, the first upper housing 134 may include upper guide 136, along which air flowing out of the first fan 182 moves to the first outlet 102*b*. The upper guide 136 induces air flowing along the first fan 182 to move downwards. The upper guide 136 induces air flowing out of the first fan 182 to move toward the first front cover 118.

The first lower housing 138 may be disposed above the first lower cover 106. Referring to FIG. 9, the first lower housing 138 may include a drain pan 140, which is disposed below the heat exchanger 186 in order to collect therein condensation dropping from the heat exchanger 186. The drain pan 140 may be disposed below the heat exchanger 186 in a region in which the heat exchanger 186 is disposed.

Figure 10:
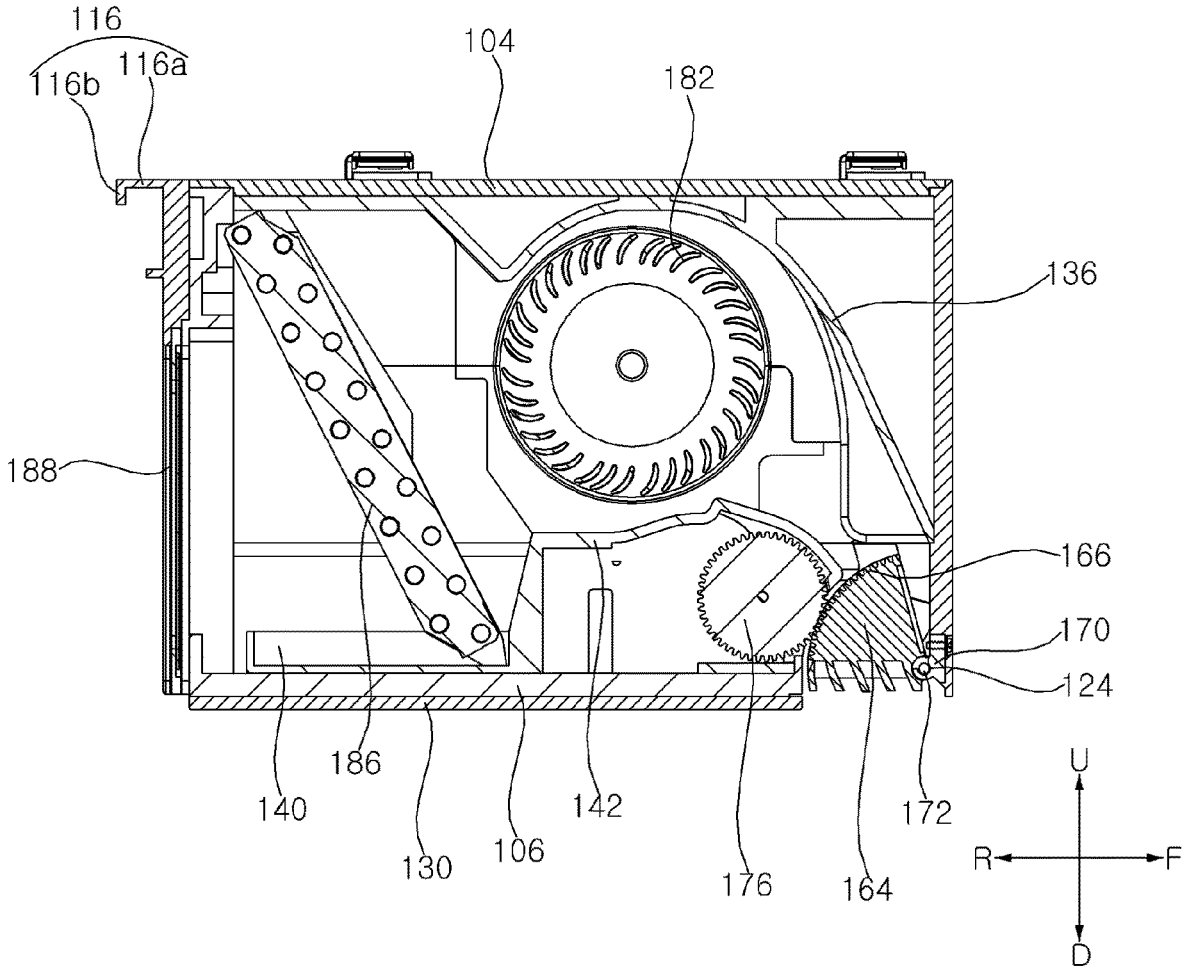
FIG. 10 is a cross-sectional view, taken along line X-X' in FIG. 7.
Figure 11:
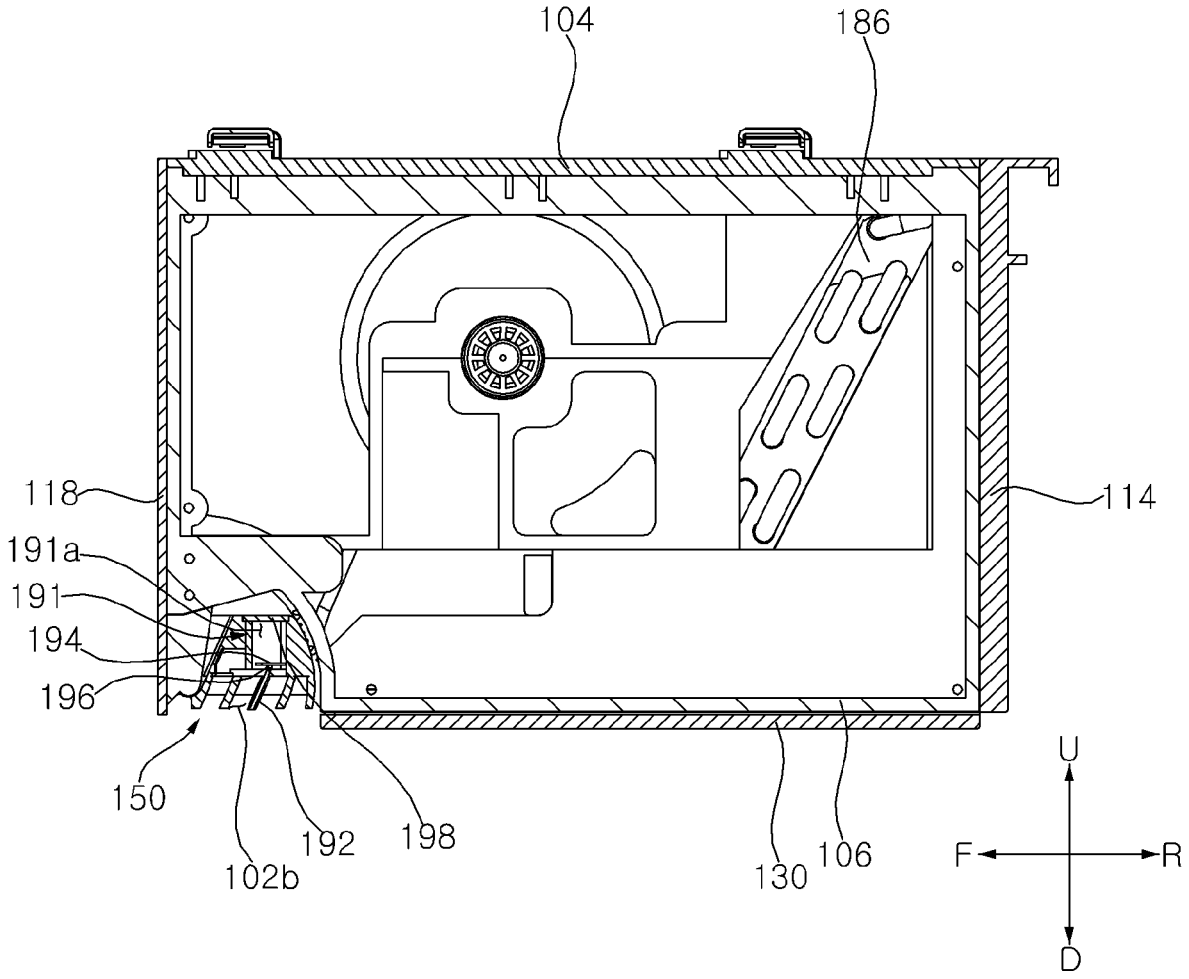
FIG. 11 is a cross-sectional view, taken along line XI-XI' in FIG. 7.

Referring to FIG. 10, the first lower housing 138 may include a drive device cover 142, which is disposed in front of the drain pan 140 and which protrudes upwards from the first lower cover 106. The drive device cover 142 forms a space thereunder in which the first louver actuator 174 may be disposed. The drive device cover 142 may protrude at an incline further upwards from a region in which the drain pan 140 is disposed to a region in which the first fan 182 is disposed. The drive device cover 142 may induce air passing through the heat exchanger 186 to flow to the region in which the first fan 182 is disposed.

The drive device cover 142 may include lower guide 144 that induces air passing through the first fan 182 to flow to the first outlet 102*b*. The lower guide 144 may be spaced apart from the upper guide 136 so as to form a discharge flow path 132*a*. The lower guide 144 may include a first gear hole 142*a* formed in a portion thereof corresponding to a region in which the first louver gear 176 of the first louver actuator 174 is disposed. Referring to FIG. 9, a portion of the first louver gear 176 may protrude outside of the first gear hole 142*a* and may be in contact with the first louver 150.

Figure 17:
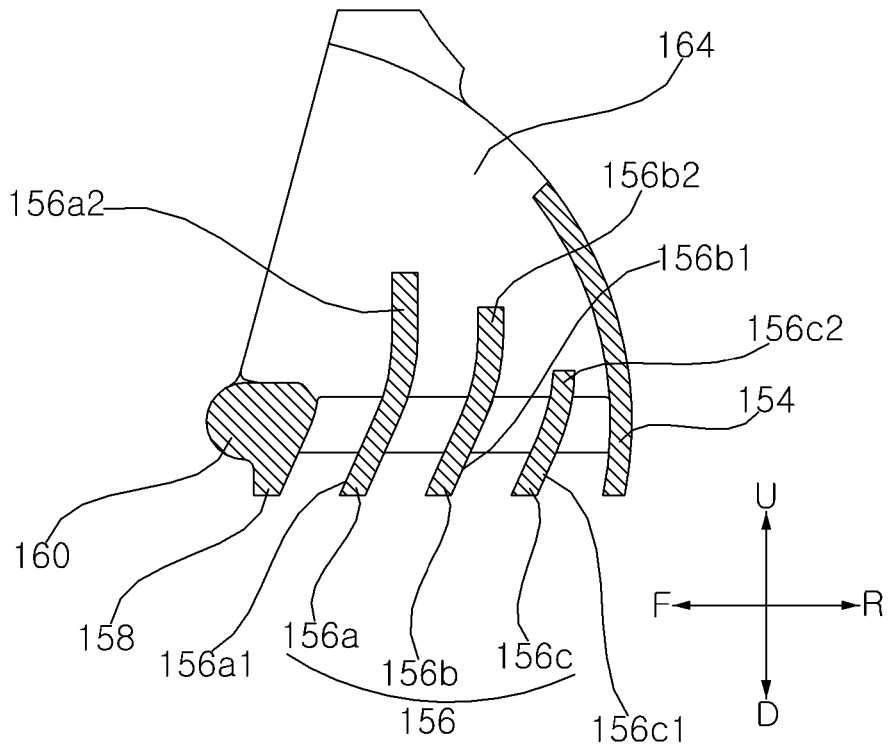
FIG. 17 is a cross-sectional view, taken along line XVII-XVII' in FIG. 16.

Referring to FIG. 6, the first air-processing apparatus 100 may include first louver 150, which is rotatably disposed in the first outlet 102*b* in order to adjust the direction of air blown out through the first outlet 102*b*, and first louver actuator 174 that adjusts the orientation of the first louver 150. Referring to FIG. 17, the first louver 150 may include a plurality of vanes 154, 156, and 158, which are spaced apart from each other in the radial direction based on the rotational shaft. Referring to FIG. 17, the first louver 150 may include louver rotational shaft 160, which extends along a rotational center of the first louver 150, outer vane 154, which is spaced outwards apart from the louver rotational shaft 160 in the radial direction, a plurality of inner vanes 156, which are spaced apart from each other in the radial direction between the louver rotational shaft 160 and the outer vane 154, and a vane gear 166, which is formed on an outer surface of the outer vane 154 in a circumferential direction.

The plurality of vanes 154, 156, and 158 may include the outer vane 154 and the plurality of inner vanes 156. Referring to FIG. 14B, the louver rotational shaft 160 may be disposed so as to be in contact with the first front cover 118. The louver rotational shaft 160 may be disposed in the first louver groove 122 in the first front cover 118. When the louver rotational shaft 160 rotates, the orientation of the plurality of vanes 154, 156, and 158, which are spaced apart from each other in the radial direction based on the louver rotational shaft 160, may be changed.

The louver rotational shaft 160 may include axial vane 158, which extends from the louver rotational shaft 160 in a direction parallel to the inner vanes 156. The axial vane 158 may extend in a direction parallel to lower portions of the inner vanes 156.

Figure 16:
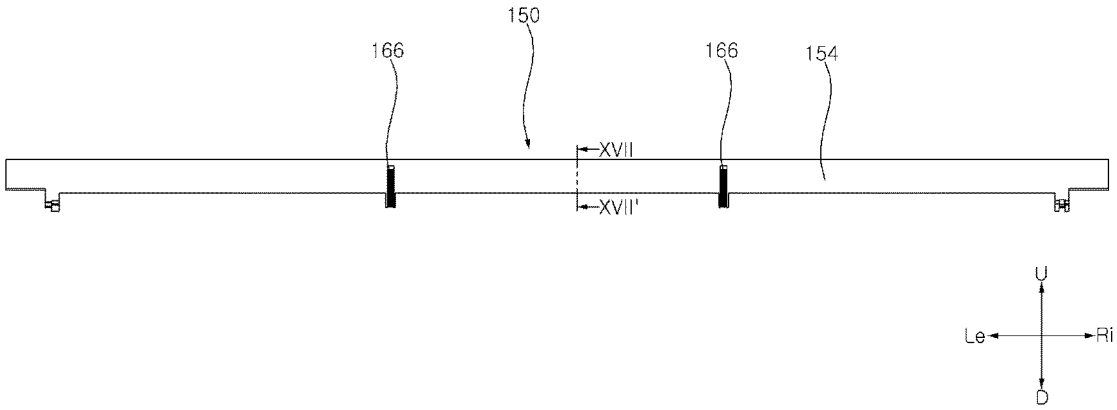
FIG. 16 is a rear view of the louver of FIG. 15.

Referring to FIG. 17, the outer vane 154 may be disposed farther from the louver rotational shaft 160 than the inner vanes 156. The outer vane 154 may be longer than the inner vanes 156 in the circumferential direction. Referring to FIG. 16, the outer vane 154 may be formed in the circumferential direction based on the louver rotational shaft 160.

Referring to FIG. 17, the inner vanes 156 may be disposed between the louver rotational shaft 160 and the outer vane 154 so as to be spaced apart from each other. The inner vanes 156 may be shorter than the outer vane 154. The inner vanes 156 may be longer than the axial vane 158.

Referring to FIG. 17, the inner vanes 156 have different lengths, respectively. The lengths of the inner vanes 156 gradually increase in a direction approaching the louver rotational shaft 160. The lengths of the inner vanes 156 gradually decrease in a direction approaching the outer vane 154.

Referring to FIG. 17, the inner vanes 156 may include lower inner vane portions 156*a*1, 156*b*1, and 156*c*1, which are inclined so as to be gradually closer to the louver rotational shaft 160 in the downward direction, and upper inner vane portions 156*a*2, 156*b*2, and 156*c*2, which are bent and extend upwards from upper ends of the lower inner vane portions 156*a*1, 156*b*1, and 156*c*1. The axial vane 158 extends in a direction parallel to the lower inner vane portions 156*a*1, 156*b*1, and 156*c*1.

The inner vanes 156 include first inner vane 156*a*, which is disposed closest to the louver rotational shaft 160, a second inner vane 156*b*, which is disposed farther from the louver rotational shaft 160 than the first inner vane 156*a*, and a third inner vane 156*c*, which is disposed farther from the louver rotational shaft 160 than the second inner vane 156*b*.

Figure 12:
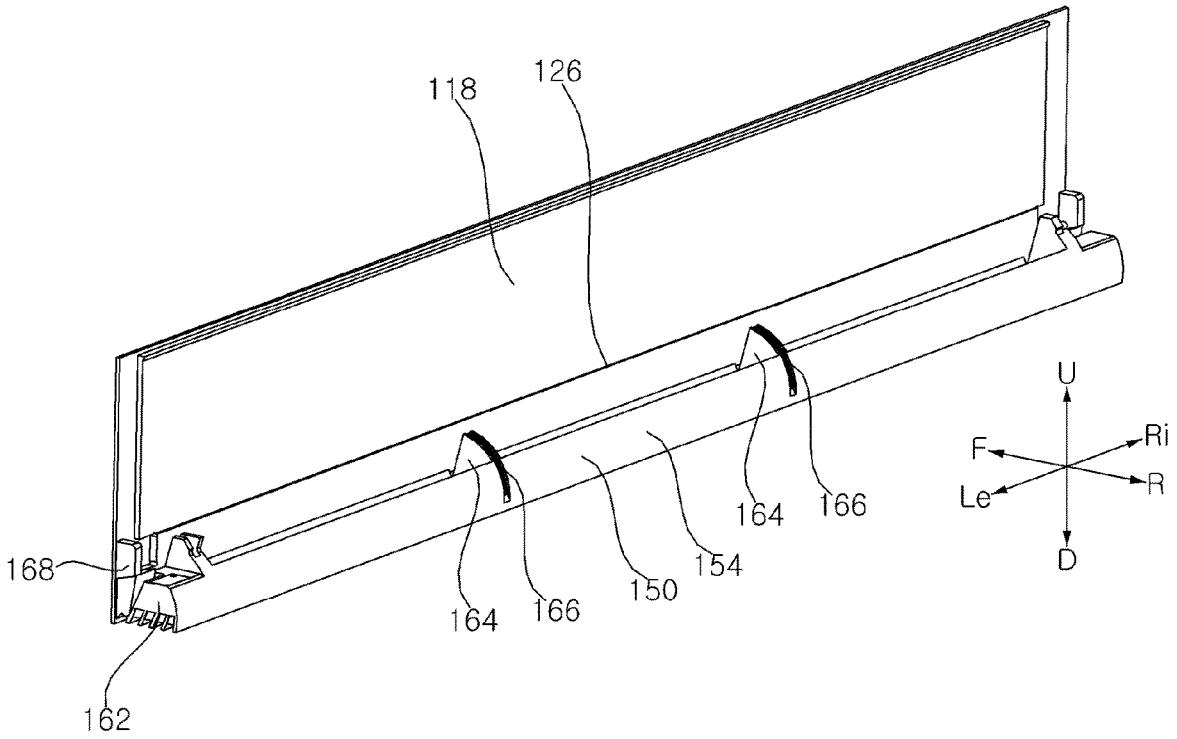
FIG. 12 is a perspective view showing a coupled state of a front cover and a louver according to an embodiment.
Figure 13:
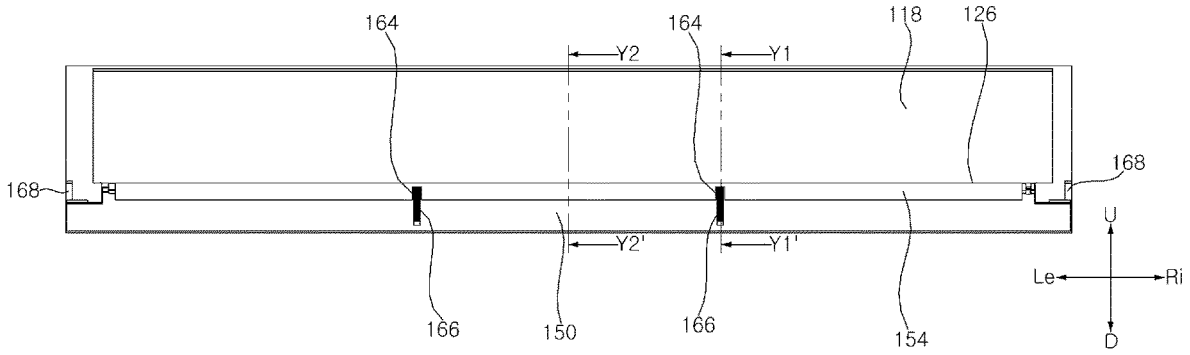
FIG. 13 is a rear view of the front cover and louver of FIG. 12.

Referring to FIG. 12, the first louver 150 may include end panels 162, which are disposed at both ends of the vanes 154, 156, and 158 in a direction perpendicular to the vanes 154, 156, and 158, and a support panel 164, which is disposed between the end panels 162. The vane gear 166 may be disposed on one side of the support panel 164. The end panels 162, which may be disposed at both ends of the vanes 154, 156, and 158, may prevent the air flowing through the first louver 150 from being discharged in the lateral direction.

The support panel 164, which is disposed between the end panels 162, may support the vanes 154, 156, and 158. The vanes 154, 156, and 158 may extend lengthwise in a longitudinal direction, in which the louver rotational shaft 160 is formed. Accordingly, the support panel 164 may stably maintain the arrangement of the vanes 154, 156, and 158.

Referring to FIG. 14A, the support panel 164 may be formed in a fan shape. The vane gear 166 may be disposed on an outer circumferential end of the support panel 164. The vane gear 166 may form threads on the outer circumferential end of the support panel 164 in the circumferential direction.

Referring to FIG. 14A, the support panel 164 may be connected to the first auxiliary support rod 170. The support panel 164 may form a space in which the first auxiliary support rod 170 is disposed in the portion in which the louver rotational shaft 160 is formed. The first auxiliary rotational shaft 172 may be disposed inside of the first auxiliary support rod 170, and the first auxiliary support rod 170 may be connected to the louver rotational shaft 160 via the first auxiliary rotational shaft 172.

The vanes 154, 156, and 158 may protrude downwards further than the end panels 162 and the support panel 164.

The first louver actuator 174 may be spaced apart from the louver rotational shaft 160 of the first louver 150 in a centrifugal direction. The first louver actuator 174 may be spaced apart from the louver rotational shaft 160, and be disposed so as to be in contact with an outer circumferential surface of the first louver 150.

Referring to FIG. 6, the first louver actuator 174 may include a first louver gear 176, which is in contact with the first louver 150 in order to rotate the first louver 150, and a first louver motor 178 that rotates the first louver gear 176. According to this embodiment, two first louver gears 176 are provided so as to be spaced apart from each other, and the first louver actuator 174 further includes a first gear rotational shaft 180 that interconnects the two first louver gears 176. The two first louver gears 176, which are connected to each other via the first gear rotational shaft 180, may rotate in the same direction.

Figure 18A:
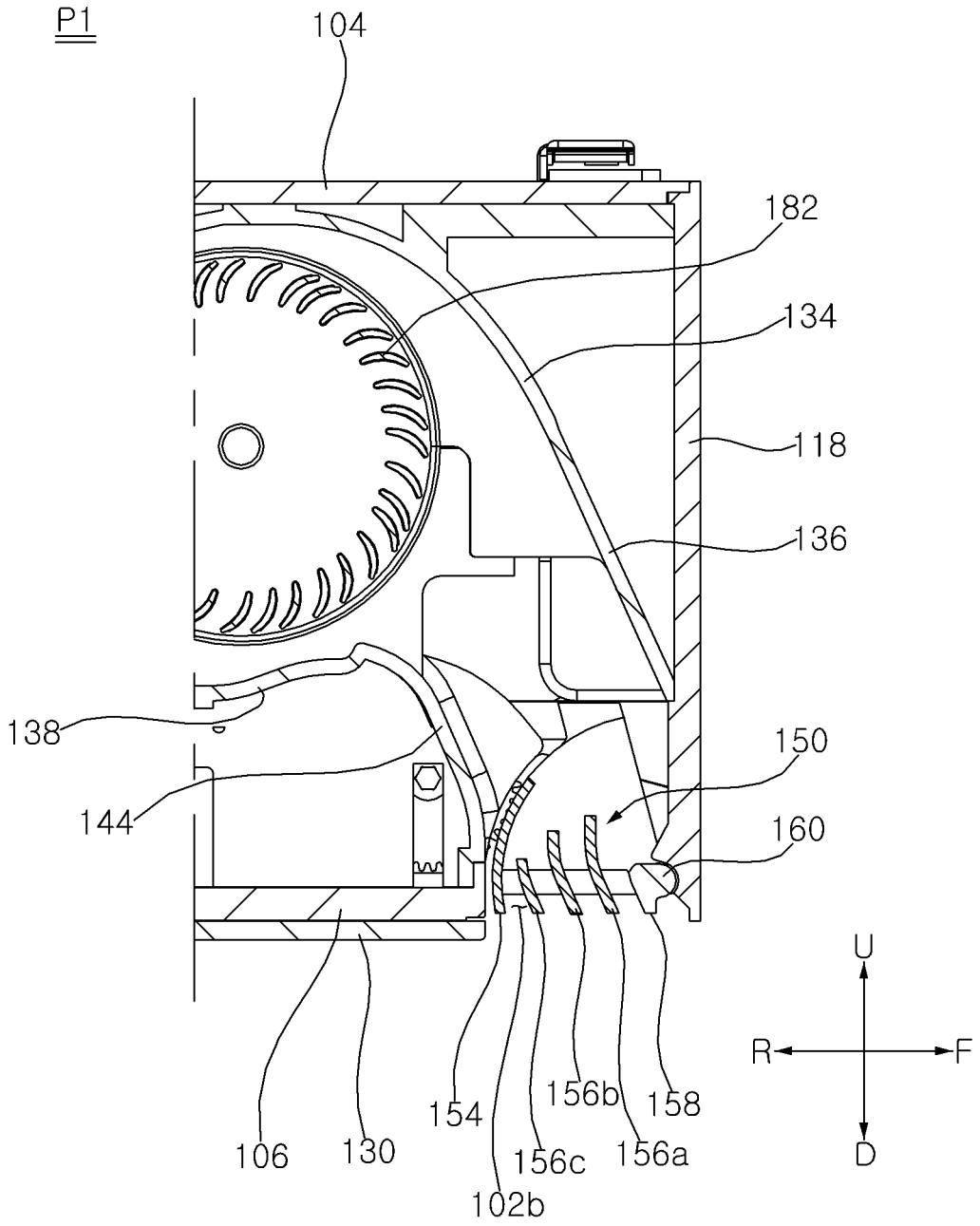
FIG. 18A is a cross-sectional view for explaining an orientation of a first louver in a first mode according to an embodiment.
Figure 18B:
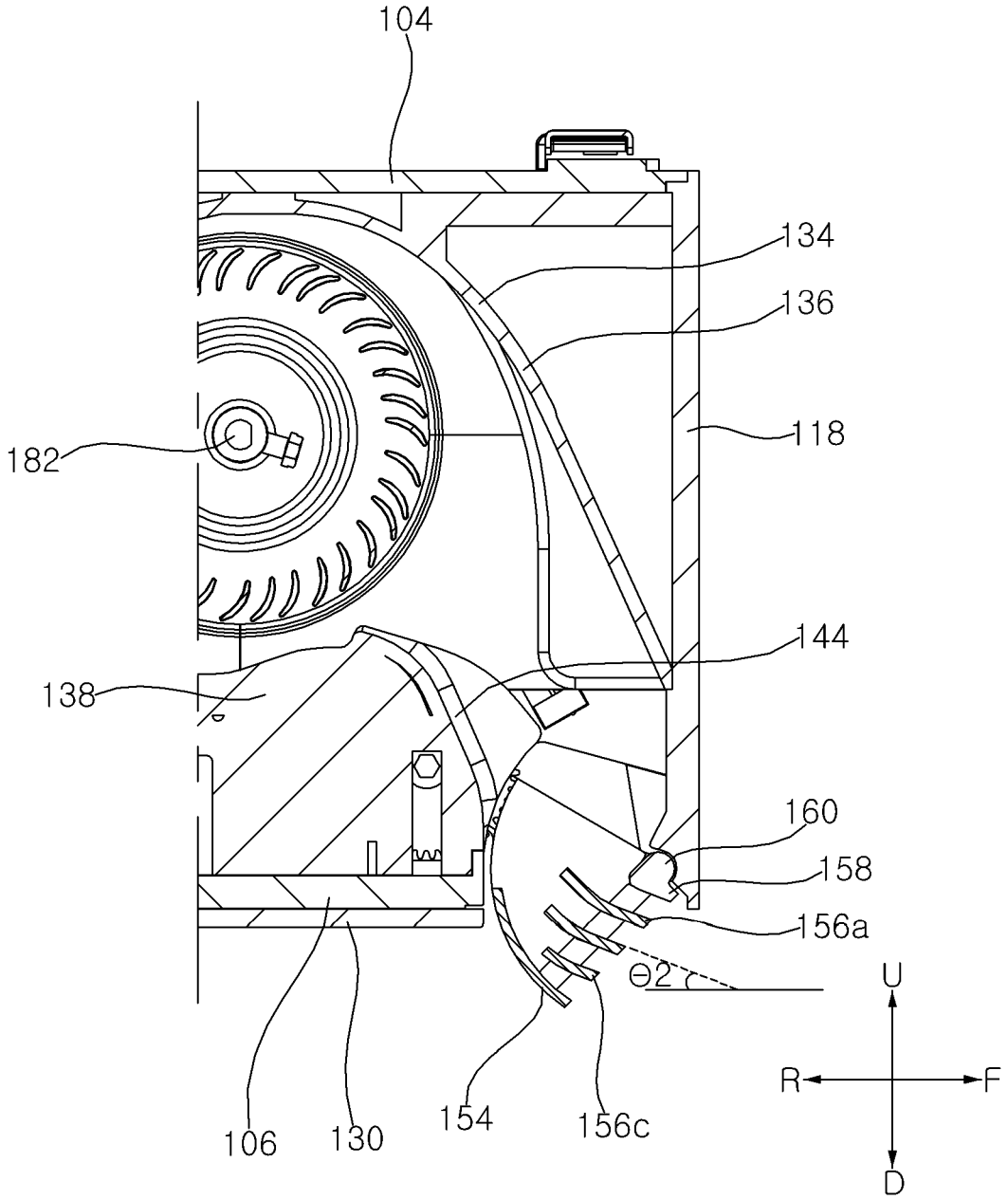
FIG. 18B is a cross-sectional view for explaining the orientation of the first louver in a second mode according to an embodiment.
Figure 18C:
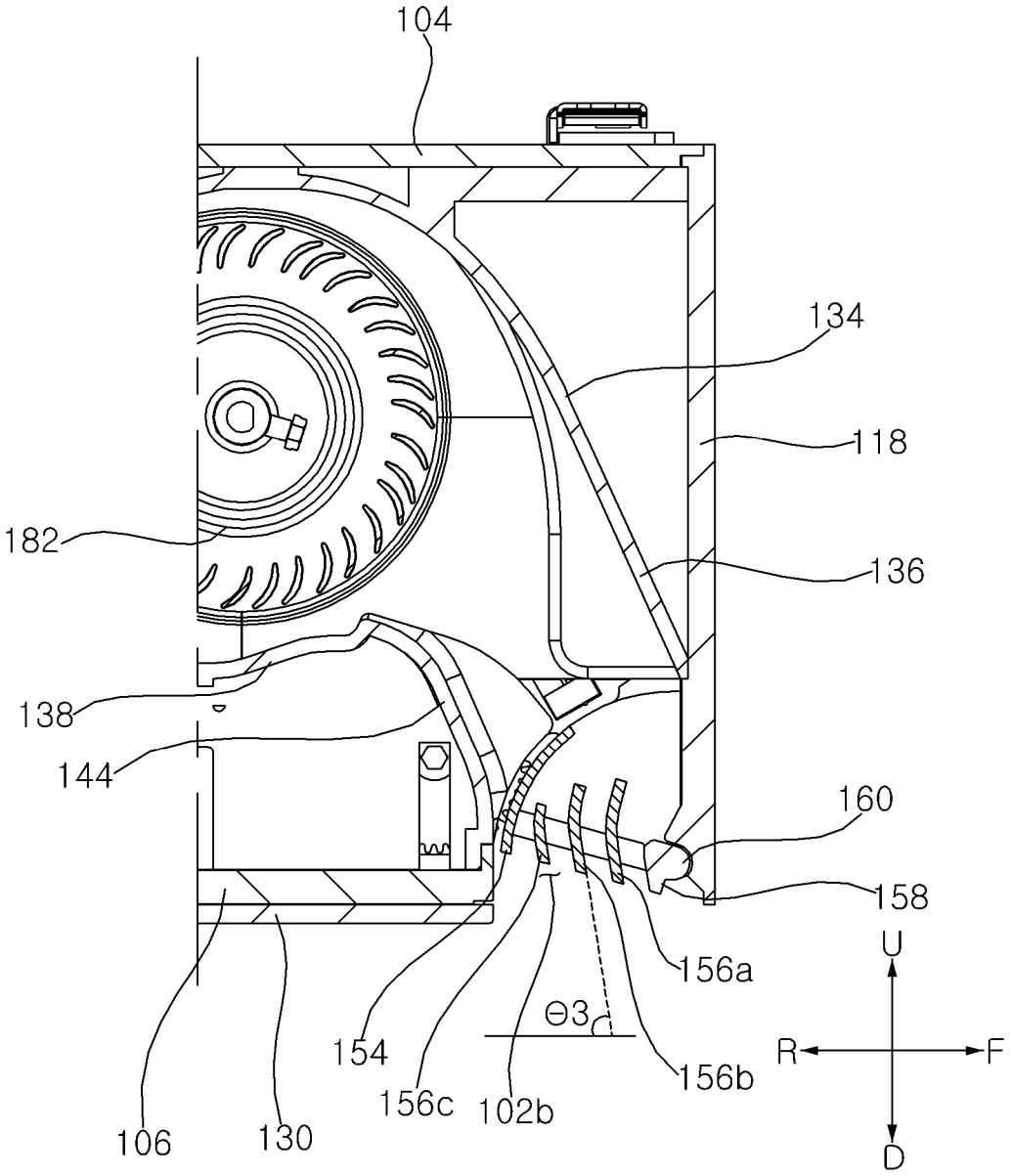
FIG. 18C is a cross-sectional view for explaining the orientation of the first louver in a third mode according to an embodiment.

Referring to FIGS. 18A to 18C, the first louver 150 may be switched to a first mode P1 for forming an oblique air current in the forward direction, a second mode P2 for forming a horizontal air current in the forward direction, and a third mode P3 for forming a vertical air current toward the floor. Referring to FIG. 18A, the first louver 150 may be disposed above the first bottom cover 130 in the first mode P1. In the first mode P1, the lower end of each of the vanes 154, 156, and 158 of the first louver 150 may be disposed above the first bottom cover 130 in the vertical direction.

In the first mode P1, the lower end of the outer vane 154 may be oriented in a direction perpendicular to the floor. In the first mode P1, the lower end of each of the inner vanes 156*a*, 156*b*, and 156*c* may be inclined in the forward direction.

Referring to FIG. 18B, a portion of the first louver 150 may be disposed below the first bottom cover 130 in the second mode P2. In the second mode P2, the lower end of the outer vane 154 and the lower end of each of the inner vanes 156*a*, 156*b*, and 156*c* may be disposed below the first bottom cover 130 in the vertical direction.

In the second mode P2, an inclination angle 82 formed by the lower inner vane portion 156*a*1, 156*b*1, 156*c*1 of each of the inner vanes 156*a*, 156*b*, and 156*c* and the floor may be set to 30 degrees or less. Accordingly, in the second mode P2, the air flowing through the first louver 150 may be discharged in a direction substantially parallel to the floor.

Referring to FIG. 18C, the first louver 150 may be disposed above the first bottom cover 130 in the third mode P3. In the third mode P3, the lower end of the outer vane 154 and the lower end of each of the inner vanes 156*a*, 156*b*, and 156*c* may be disposed above the first bottom cover 130 in the vertical direction.

In the third mode P3, an inclination angle 83 formed by the lower inner vane portion 156*a*1, 156*b*1, 156*c*1 of each of the inner vanes 156*a*, 156*b*, and 156*c* and the floor may be set to a range from 60 degrees to 90 degrees. Accordingly, in the third mode P3, the air flowing through the first louver 150 may be discharged in a direction substantially perpendicular to the floor.

Hereinafter, a second air-processing apparatus according to an embodiment will be described with reference to FIGS. 19 to 35C.

Figure 19:
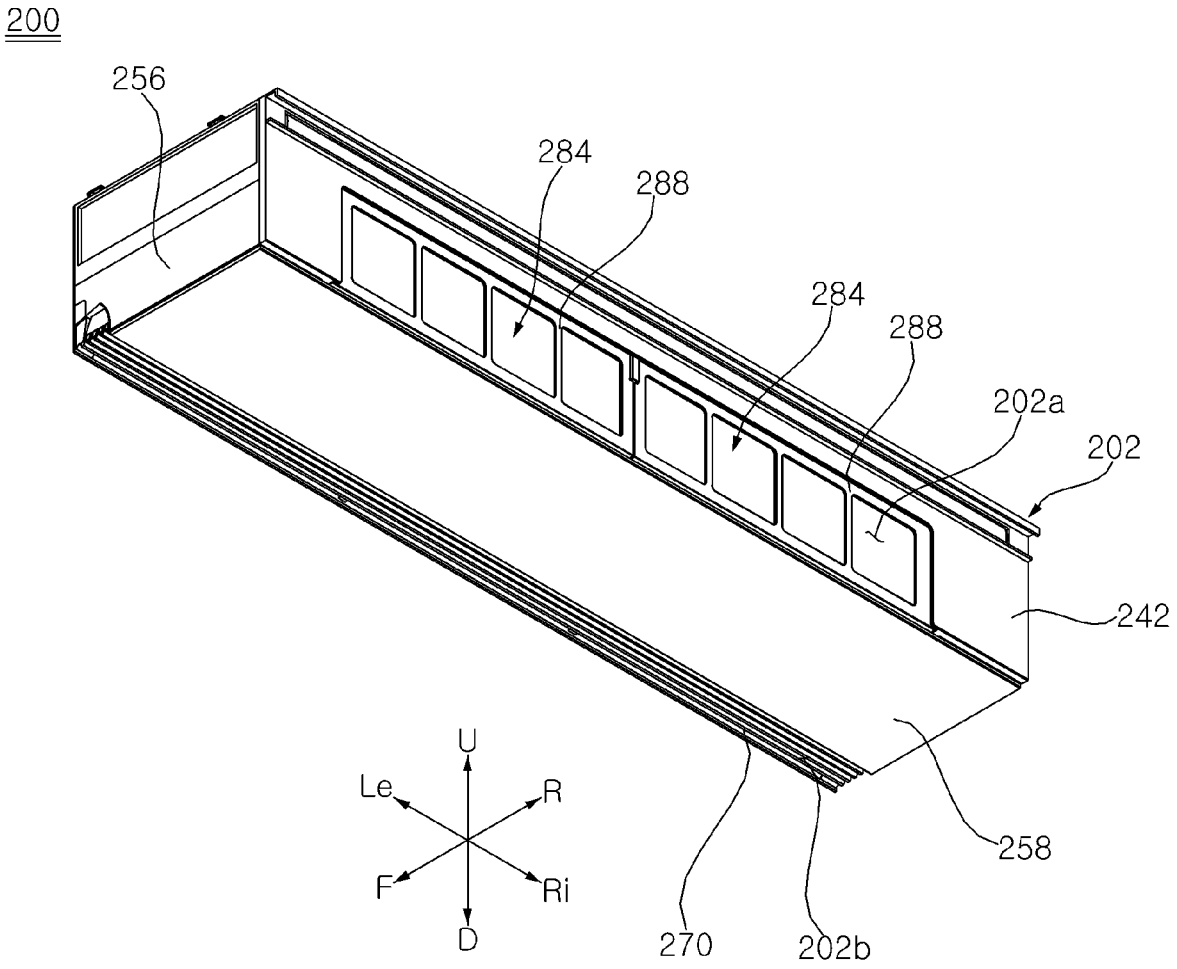
FIG. 19 is a perspective view of a second air-processing apparatus according to an embodiment.

The second air-processing apparatus 200 induces air to flow through a filter device 284 and discharges the air to the outside. The second air-processing apparatus 200 may include a second inlet 202*a* formed in one or a first side thereof in order to suction air thereinto and a second outlet 202*b* formed in another or a second side thereof perpendicular to the second inlet 202*a* in order to discharge air therefrom. Referring to FIG. 19, the second inlet 202*a* may be formed so as to extend perpendicular to a surface of a floor or ceiling. The second outlet 202*b* may be formed so as to be open downwards. The second outlet 202*b* may extend perpendicular to the second inlet 202*a*.

Figure 20:
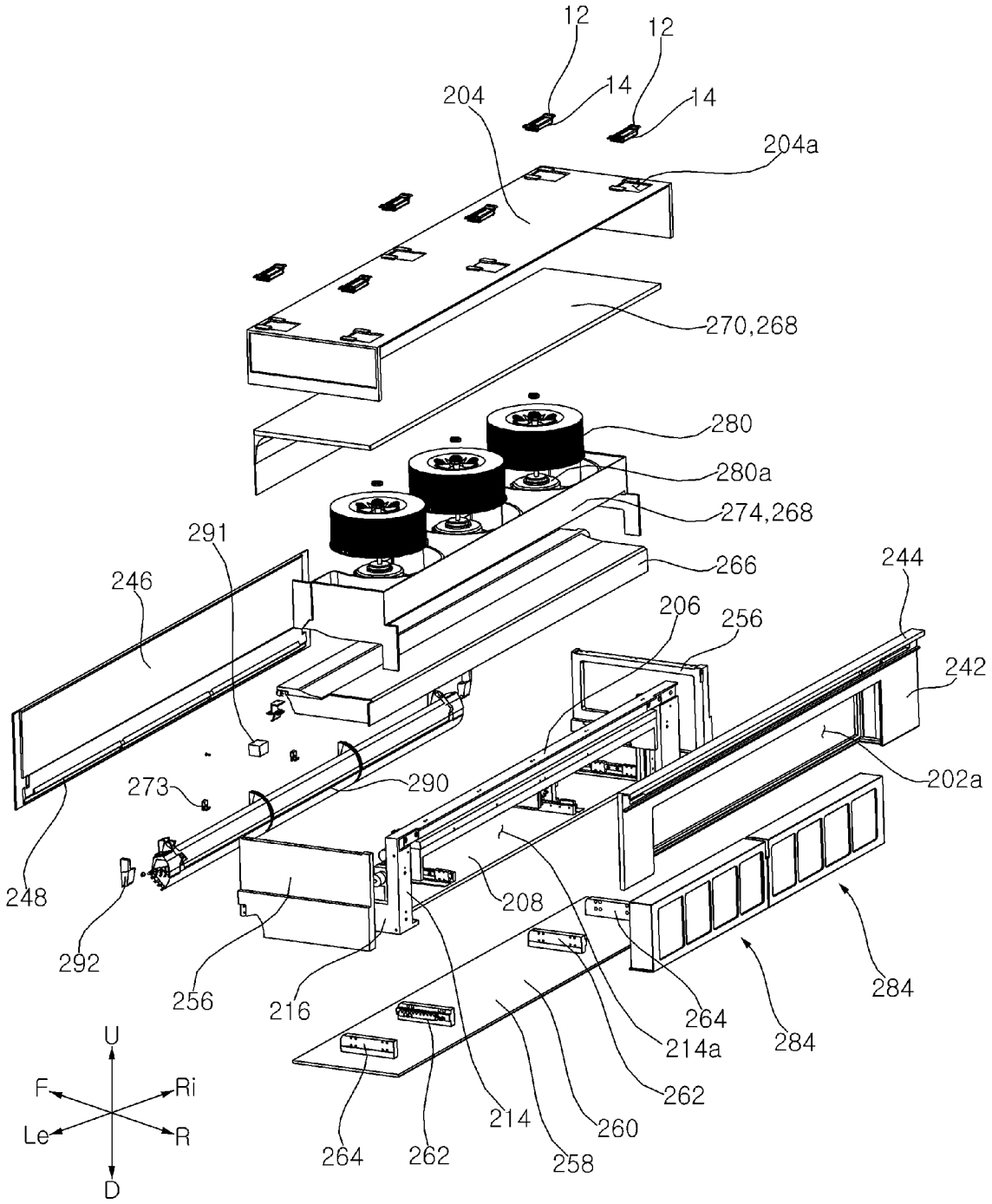
FIG. 20 is an exploded perspective view of the second air-processing apparatus of FIG. 19.
Figure 21:
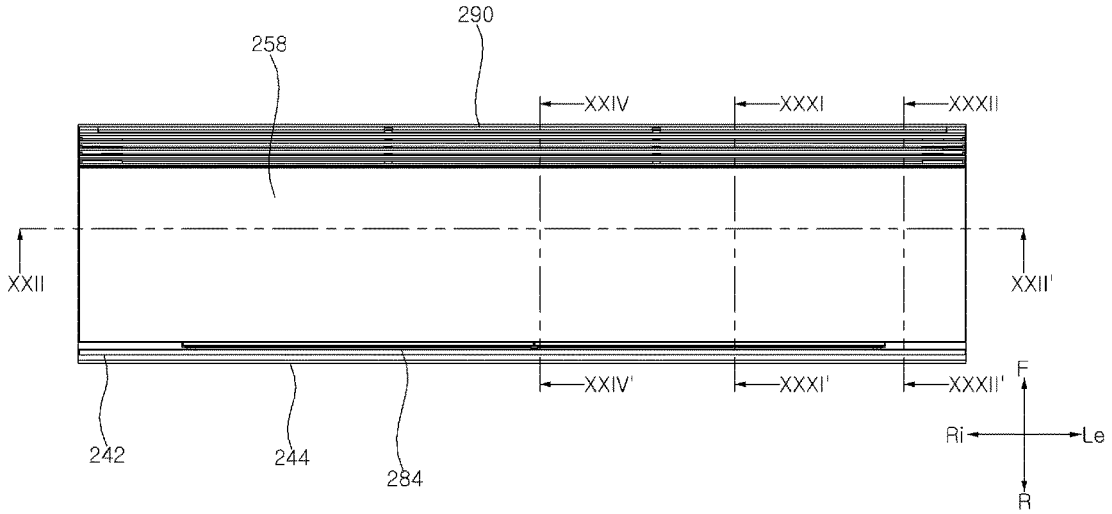
FIG. 21 is a bottom view of the second air-processing apparatus of FIG. 19.
Figure 22:
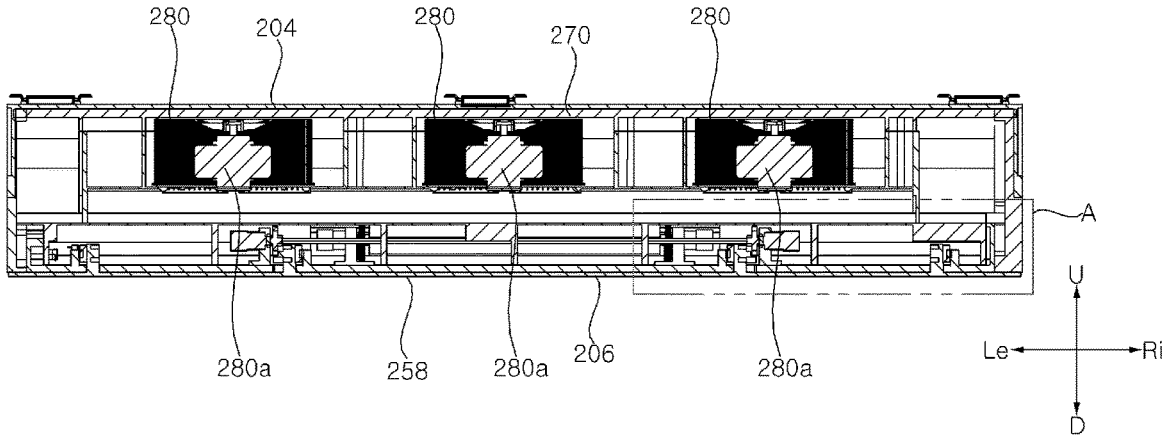
FIG. 22 is a cross-sectional view, taken along line XXII-XXII' in FIG. 21.

Referring to FIG. 20, the second air-processing apparatus 200 may include a second fan 280, which causes air to flow, and a second fan motor 280*a*, which rotates the second fan 280. According to this embodiment, a plurality of second fans 280 may be provided, and a plurality of second fan motors 280*a* may be provided such that each of the second fan motors 280*a* is connected to a respective one of the plurality of second fans 280.

The second air-processing apparatus 200 may include a second case 202, which forms an external appearance of the second air-processing apparatus 200, and a second housing 268, which is disposed inside of the second case 202 and which forms a flow path through which air flows. The second air-processing apparatus 200 may further include a second louver 290, which is rotatably disposed in the second case 202 in order to adjust a direction of air that is discharged from the second outlet 202*b*, and a second louver actuator 294, which changes an orientation of the second louver 290.

The second louver 290 and the second louver actuator 294 disposed in the second air-processing apparatus 200 may have the same structures and perform the same functions as the first louver 150 and the first louver actuator 174 of the first air-processing apparatus 100 described above with reference to FIGS. 12 to 17. Therefore, the description of the first louver 150 and the first louver actuator 174 of the first air-processing apparatus 100 may apply to the second louver 290 and the second louver actuator 294 disposed in the second air-processing apparatus 200.

The second air-processing apparatus 200 may include a second control box 291 that controls operation of the second fan motor 280*a* or operation of the second louver actuator 294.

Referring to FIG. 20, the second case 202 may include a second upper cover 204, which may be secured to a ceiling, a second lower cover 206, which is disposed below the second upper cover 204, second rear cover 242, which forms therein the second inlet 202*a* and to which the filter device 284 is mounted, a second front cover 246, which is disposed so as to be spaced forwards apart from the second rear cover 242, and two second side covers 256, which are disposed at both side ends of the second lower cover 206. The second case 202 may further include a second bottom cover 258, which is disposed below the second lower cover 206 so as to be movable in the forward-rearward direction.

Referring to FIG. 20, the second inlet 202*a* may be formed in the second rear cover 242. The guide rail 10 (refer to FIG. 3) may be mounted on an outer surface of the second rear cover 242. The second inlet 202*a*, in which the filter device 284 is mounted, may be formed in a lower portion of the second rear cover 242. The guide rail 10 and the second support rail 244 that guides movement of the filter cleaner 300 may be mounted on the second rear cover 242.

Figure 24:
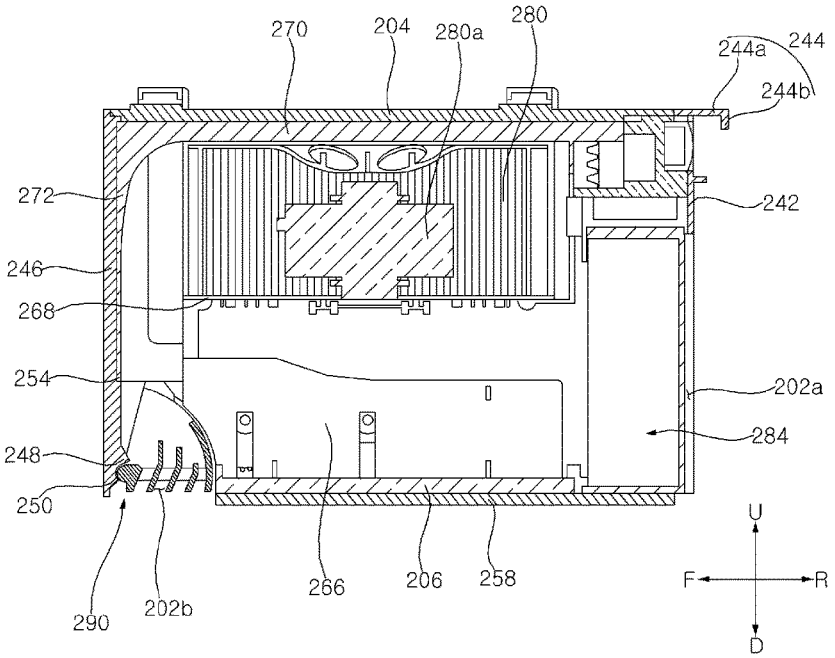
FIG. 24 is a cross-sectional view, taken along line XXIV-XXIV' in FIG. 21.

The guide rail 10 may be disposed above the second inlet 202*a*. Referring to FIG. 24, the second support rail 244 may be disposed at an upper end of the second rear cover 242.

The second support rail 244 may include a second top plate 244*a*, which protrudes rearwards from an upper end of the second rear cover 242, and a second bent portion 244*b*, which is bent and extends downwards from a rear end of the second top plate 244*a*. The top roller 326 of the filter cleaner 300 may be in contact with the second bent portion 244*b*.

The second rear cover 242 may be disposed behind a second vertical plate 214 of the second lower cover 206, which will be described hereinafter. The second rear cover 242 may be fixedly disposed behind the second vertical plate 214.

A filter-mounting part or portion or filter mount 234 (refer to FIG. 31) that moves the filter device 284 in the upward-downward direction may be disposed in the second inlet 202*a* in the second rear cover 242. The filter-mounting portion 234 may be moved in the upward-downward direction by a filter-drive device 228, which will be described hereinafter.

Referring to FIG. 20, the second upper cover 204 may include a second fixing recess 204*a* formed in an upper surface thereof, into which fixing member 12 that fixes the second case 202 to the ceiling may be inserted. The second fixing recess 204*a* formed in the second upper cover 204 may have a same shape as the first fixing recess 104*a* formed in the first upper cover 104. Accordingly, the second upper cover 204 may be fixed to mounting member 14 mounted to the ceiling by the fixing member 12 disposed at an upper side of the first upper cover 104.

Referring to FIG. 20, the second upper cover 204 may include two side plates 266*d*, which are bent and extend downwards from both side ends thereof. Each of the two side plates 266*d* may be connected to a respective one of the two second side covers 256.

Figure 23:
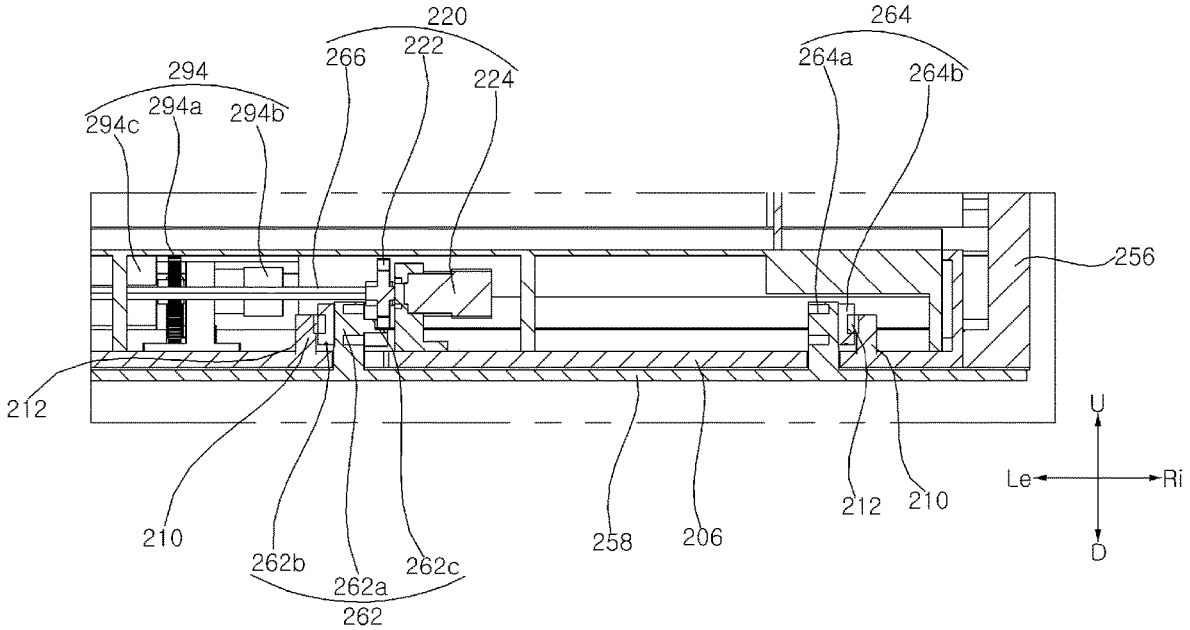
FIG. 23 is an enlarged view of portion A in FIG. 22.

Referring to FIG. 23, the second lower cover 206 may be disposed below the second housing 268. The second louver actuator 294 may be disposed on the second lower cover 206. A cover-drive device 220 that moves the second bottom cover 258 in the forward-rearward direction may be disposed on the second lower cover 206. The filter-drive device 228 that moves the filter device 284 and the filter-mount 234 in the upward-downward direction may be disposed on the second lower cover 206.

The second lower cover 206 may include a second horizontal plate 208, which is disposed above the second bottom cover 258, a second vertical plate 214, which is disposed at a rear side of the second horizontal plate 208 so as to be perpendicular thereto and in which a second inner suction hole 214*a* is formed, and two second side walls 216, which are bent and extend upwards from both side ends of the second horizontal plate 208.

Figure 33A:
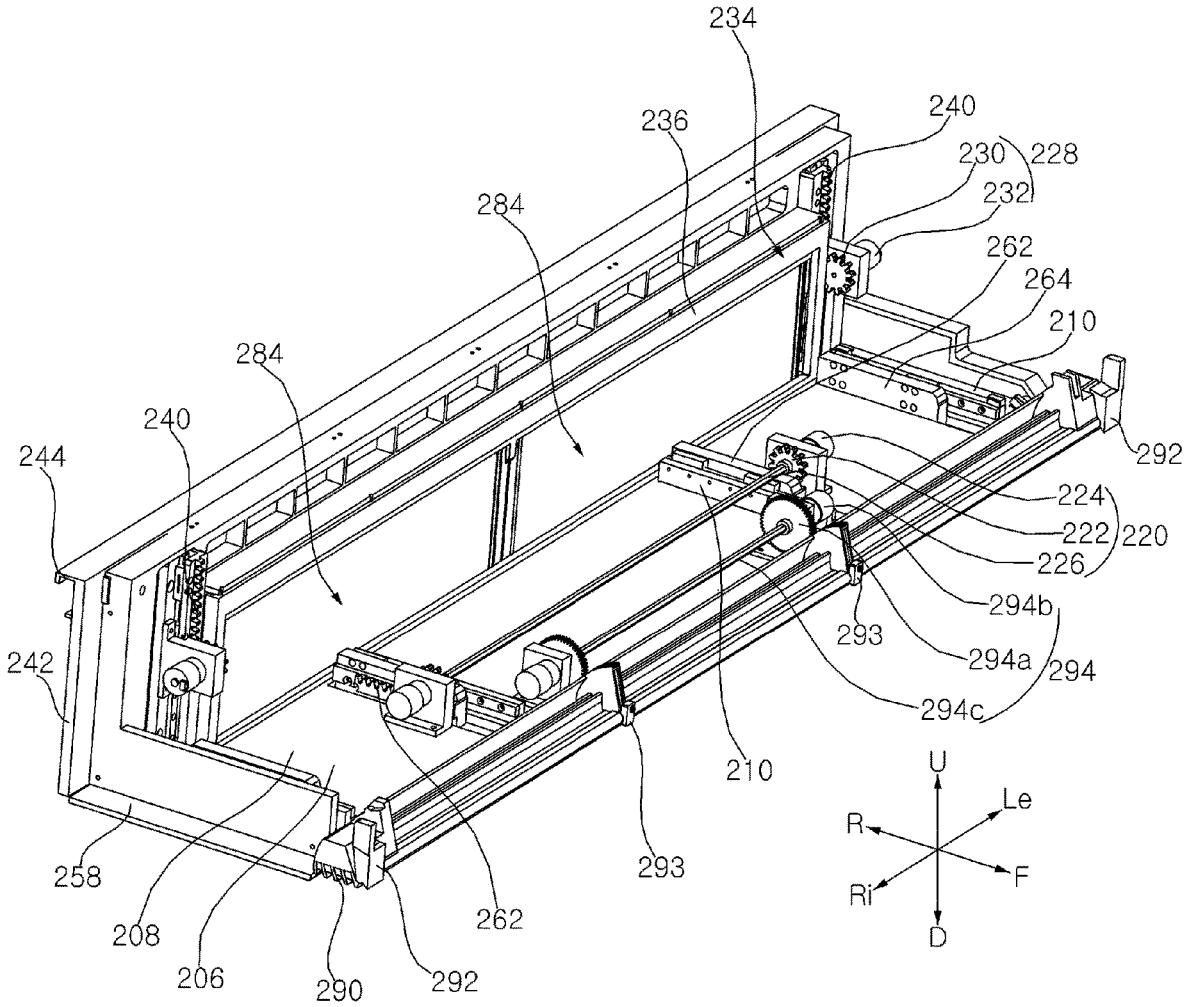
FIG. 33A is a perspective view for explaining an arrangement of a second bottom cover, the filter-mount, and the filter device in a state in which the second bottom cover is located at a rear position.

Referring to FIG. 33A, the second louver actuator 294 is disposed on the second horizontal plate 208. The cover-drive device 220 is disposed above the second horizontal plate 208. The second horizontal plate 208 has guide grooves 208*a* formed therein to allow cover guides 262 and 264 of the second bottom cover 258 to be inserted thereinto.

Figure 31:
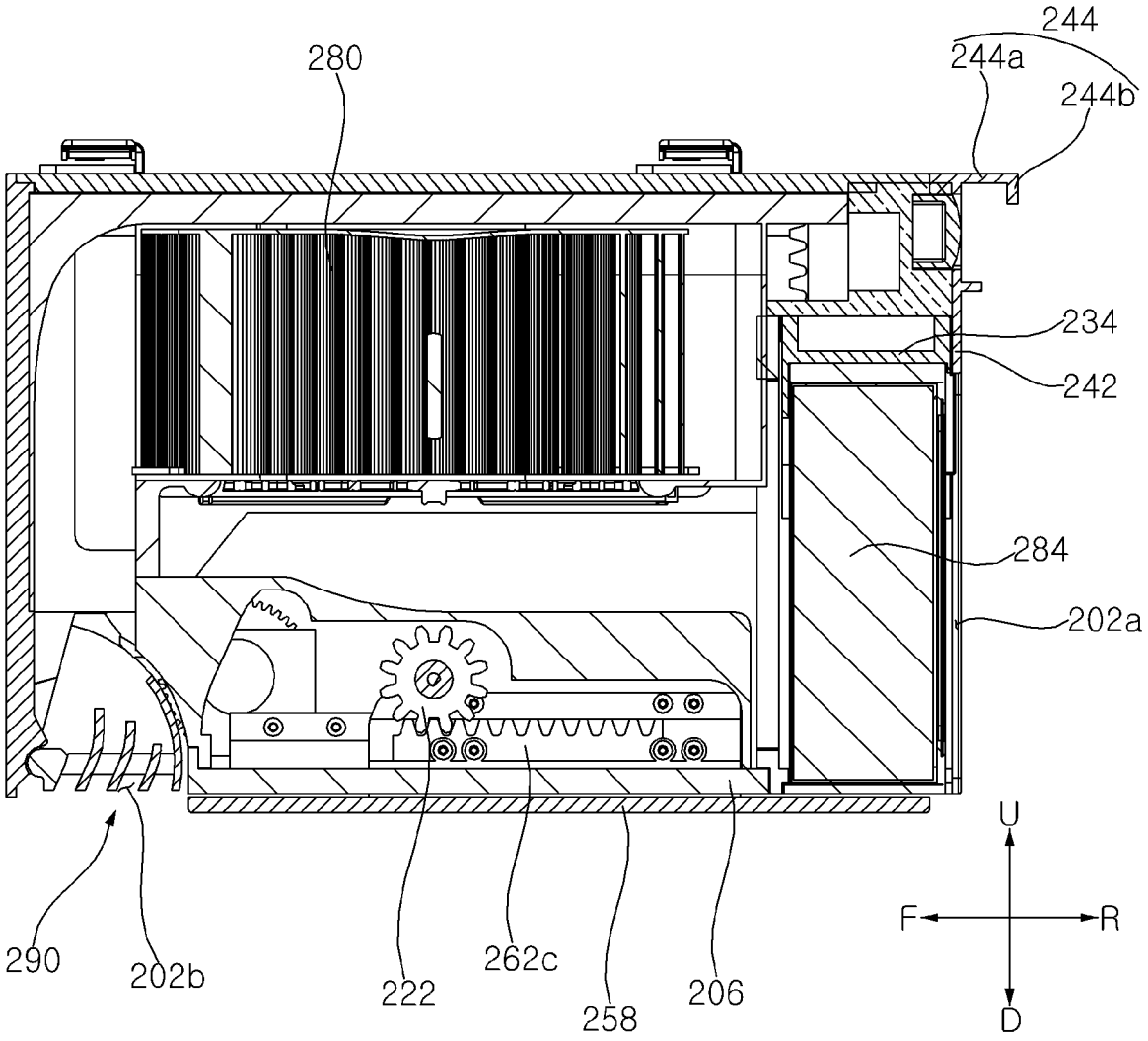
FIG. 31 is a cross-sectional view, taken along line XXXI-XXXI' in FIG. 21.

Referring to FIGS. 31 and 33A, the cover-drive device 220 may include a cover-drive gear 222, which meshes with a guide gear 262*c* of the first cover guide 262, which will be described hereinafter, so as to rotate together therewith, and a cover-drive motor 224 that rotates the cover-drive gear 222.

According to this embodiment, two cover-drive gears 222 may be provided so as to be spaced apart from each other in the lateral direction. The cover-drive device 220 may include a cover-drive shaft 226 that interconnects the two cover-drive gears 222 spaced apart from each other. Accordingly, the two cover-drive gears 222 connected to both ends of the cover-drive shaft 226 may rotate identically.

Referring to FIG. 33A, the second horizontal plate 208 may be provided with fixing guides 210, which may be connected to the cover guides 262 and 264 of the second bottom cover 258 in order to prevent the second bottom cover 258 from moving in the upward-downward direction. The fixing guides 210 may protrude upwards from the second horizontal plate 208, and extend in the forward-rearward direction.

Referring to FIG. 33A, the fixing guides 210 may be disposed so as to be in contact with the first cover guide 262 or the second cover guide 264, which will be described hereinafter. The fixing guides 210 support movement of the second bottom cover 258 in the forward-rearward direction. The fixing guides 210 may also prevent the second bottom cover 258 from moving in the upward-downward direction.

Referring to FIG. 23, the fixing guides 210 may have fixing protrusions 212, which protrude toward the cover guides 262 and 264. The fixing protrusions 212 extend in the forward-rearward direction. The fixing protrusions 212 may be disposed so as to be in contact with a first guide protrusion 262*b* of the first cover guide 262 or a second guide protrusion 264*b* of the second cover guide 264.

The fixing protrusions 212 have a structure corresponding to the first guide protrusion 262*b* of the first cover guide 262 or the second guide protrusion 264*b* of the second cover guide 264, thereby preventing the second bottom cover 258 from moving in the upward-downward direction.

Referring to FIG. 20, the second vertical plate 214 may have a second inner suction hole 214*a* formed therein. The second inner suction hole 214*a* may have a size corresponding to the second inlet 202*a*. The filter-drive device 228 may be disposed on the second vertical plate 214.

Each of the two second side covers 256 may be connected at a lower portion thereof to the second lower cover 206, and be connected at an upper portion thereof to the second upper cover 204. A second rotational support rod 292 that supports rotation of the second louver 290 may be disposed on each of the two second side covers 256. The second rotational support rod 292, which is connected to each of the second side covers 256, may have a same shape as the first rotational support rod 168 connected to each of the first side covers 128.

The second front cover 246 may be disposed in front of the second housing 268. The second front cover 246 may have a same shape as the first front cover 118. Also, the second front cover 246 may be disposed in the same manner as the first front cover 118. Therefore, a lower end of the second front cover 246 may be spaced a predetermined gap apart from a front end portion of the second lower cover 206, thereby forming the second outlet 202*b*.

In addition, a second louver protrusion 248, in which a second louver groove 250 that receives a second louver rotational shaft 270*a* of the second louver 290 may be formed, may be formed on the second front cover 246 in order to limit a range within which the second louver 290 may rotate. A second support-rod recess 252, in which a second auxiliary support rod 293 may be disposed, may be formed between a left or first lateral end and a right or second lateral end of the second louver protrusion 248.

Referring to FIG. 24, a second stepped portion or step 254, which interferes with an end portion of a second upper housing 270 described hereinafter, may be formed in the second front cover 246.

Figure 33B:
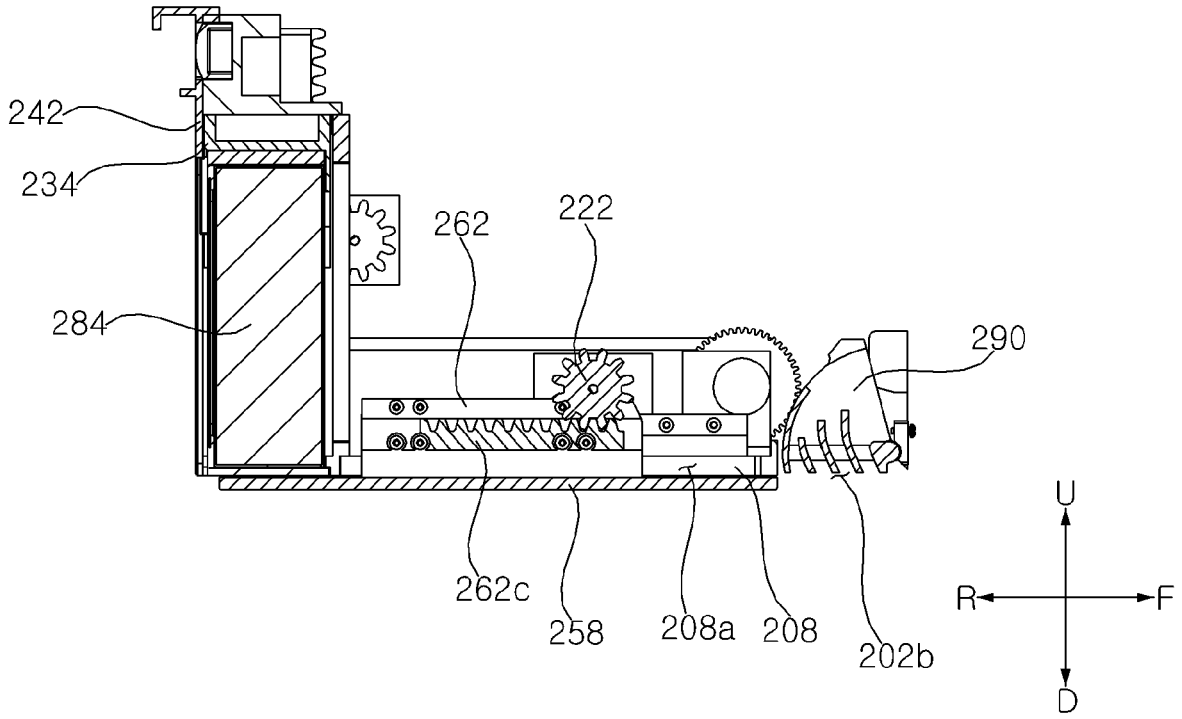
FIG. 33B is a cross-sectional view of the arrangement of FIG. 33A.

The second bottom cover 258 may be disposed at the second lower cover 206 so as to be movable in the forward-rearward direction. Referring to FIG. 33B, when the second bottom cover 258 is disposed at a rear position adjacent to the second rear cover 242, the second bottom cover 258 may cover a lower side of the filter device 284. Referring to FIG. 34B, when the second bottom cover 258 is disposed at a front position adjacent to the second front cover 246, the second bottom cover 258 may block the second outlet 202*b*. Referring to FIG. 34B, when the second bottom cover 258 is disposed at a front position adjacent to the second front cover 246, the second bottom cover 258 may open the lower side of the filter device 284.

Referring to FIG. 20, the second bottom cover 258 may include a bottom plate 260, which may be disposed below the second lower cover 206, and cover guides 262 and 264, which protrude upwards from the bottom plate 260 and which move the bottom plate 260 in the forward-rearward direction. Referring to FIG. 23, the cover guides 262 and 264 may include first cover guide 262, which may be connected to the cover-drive device 220 to move the bottom plate 260, and a second cover guide 264, which prevents the bottom plate 260 from vibrating in the upward-downward direction.

Referring to FIG. 23, the first cover guide 262 may include a first guide wall 262*a*, which protrudes upwards from the bottom plate 260 and extends in the forward-rearward direction, a guide gear 262*c*, which is disposed on one or a first side of the first guide wall 262*a* and is screwed to the cover-drive device 220, and a first guide protrusion 262*b*, which is disposed on the opposite or a second side of the first guide wall 262*a* and guides movement of the second bottom cover 258 in the forward-rearward direction. A recess 262*b*1, into which the fixing protrusion 212 may be inserted, may be formed in the first guide protrusion 262*b*.

Referring to FIG. 23, the second cover guide 264 may include a second guide wall 264*a*, which protrudes upwards from the bottom plate 260 and extends in the forward-rearward direction, and a second guide protrusion 264*b*, which is disposed on one side of the second guide wall 264*a* and guides movement of the second bottom cover 258 in the forward-rearward direction. A recess 264*b*1, into which the fixing protrusion 212 may be inserted, may be formed in the second guide protrusion 264*b*.

Referring to FIG. 20, the second air-processing apparatus 200 may include an inner cover 266, which may be disposed above the second lower cover 206 and cover upper sides of the second louver actuator 294 and the cover-drive device 220. Referring to FIG. 24, the inner cover 266 may guide a flow of air flowing inside of the second case 202, and may prevent the air from flowing to the second louver actuator 294. The inner cover 266 may be coupled to the second lower cover 206 to form a space in which the second louver actuator 294 and the cover-drive device 220 are disposed.

Figure 25A:
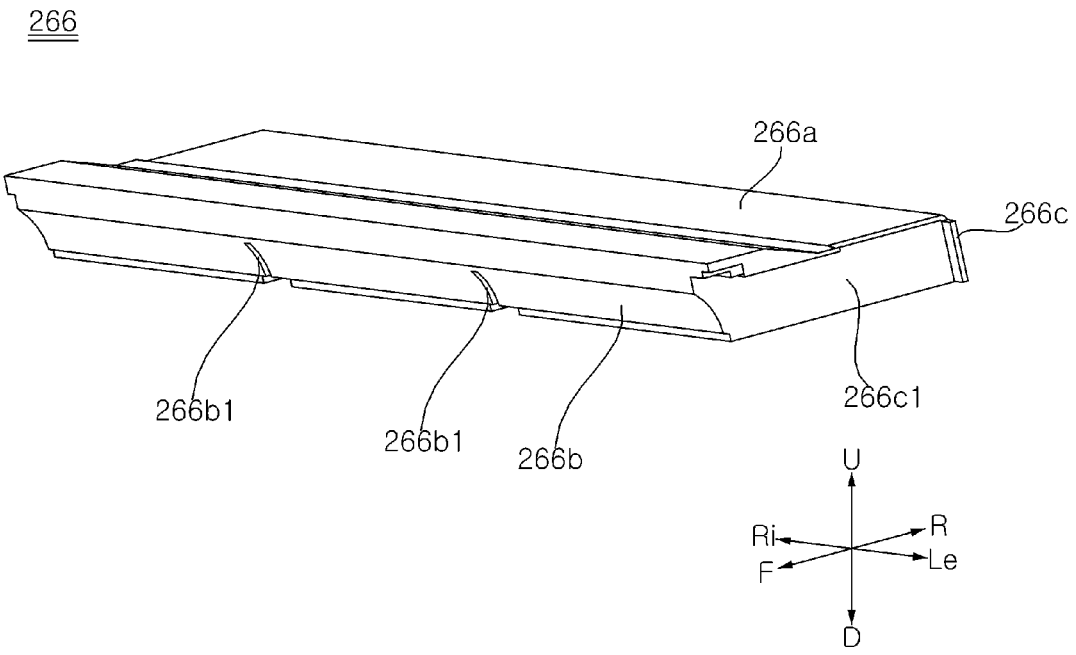
FIG. 25A is a perspective view of an inner cover according to an embodiment.
Figure 25B:
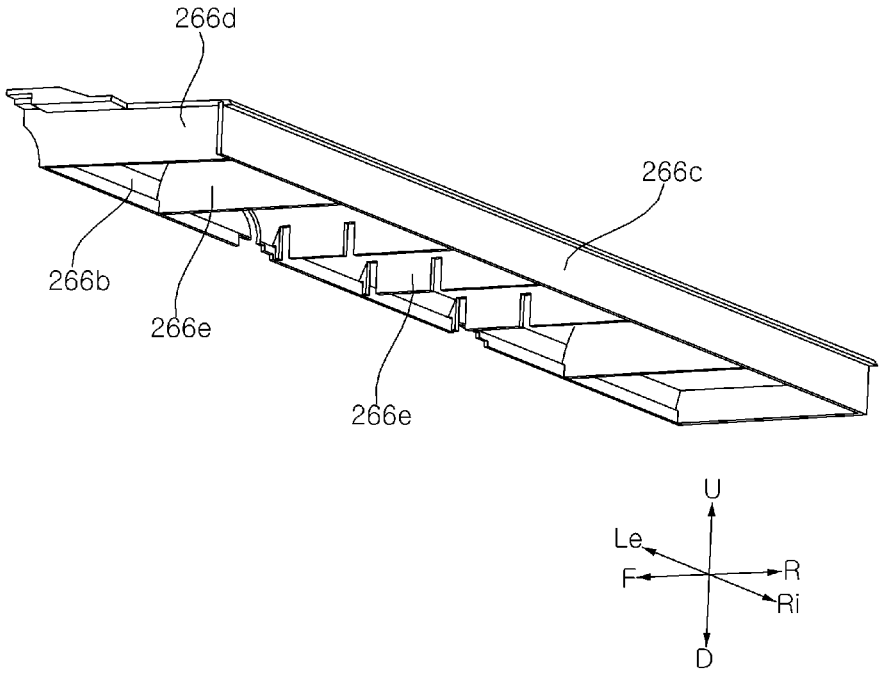
FIG. 25B is a perspective view of the inner cover when viewed from a direction different from that of FIG. 25A.

Referring to FIGS. 25A and 25B, the inner cover 266 may include an upper plate 266*a*, which may be disposed above the second louver actuator 294, a front plate 266*b*, which covers a front side of the second louver actuator 294, a rear plate 266*c*, which covers a rear side of the second louver actuator 294, and side plates 266*d*, which cover the lateral sides of the second louver actuator 294.

The rear plate 266*c* may prevent the air flowing through the filter device 284 from flowing to the space under the inner cover 266. The upper plate 266*a* may guide the air flowing through the filter device 284 to the space in which the second fan 280 is disposed. The front plate 266*b* may guide the air flowing through the second fan 280 toward the second outlet 202*b*. The front plate 266*b* may have a second gear hole 266*b*1 formed in a region in which a second louver gear 294*a* of the second louver actuator 294 is disposed. A portion of the second louver gear 294*a* may protrude outside of the second gear hole 266*b*1 (refer to FIG. 25A), and may be in contact with the second louver 290.

Referring to FIG. 25B, the inner cover 266 may include a plurality of partition walls 266*e*, which vertically extend downwards from the upper plate 266*a*. The plurality of partition walls 266*e* may be spaced apart from each other in the lateral direction, and may increase a rigidity of the inner cover 266.

Referring to FIG. 24, the second housing 268 may be disposed inside of the second case 202 to form a space in which air flows. A second fan 280 and a second fan motor 280*a* that rotates the second fan 280 may be disposed inside of the second housing 268.

The second fan 280 may be implemented as, for example, a centrifugal fan, which suctions air in a direction parallel to a rotational axis and discharges air in a centrifugal direction. Accordingly, referring to FIG. 24, the second fan motor 280*a* may be disposed inside of the second fan 280 to rotate the second fan 280.

The second fan motor 280*a* may be fixed to second upper housing 270, which will be described hereinafter. Referring to FIG. 24, the second housing 268 may include a second upper housing 270, which is disposed above the second fan 280, and a second lower housing 274, which is disposed below the second fan 280.

Figure 26A:
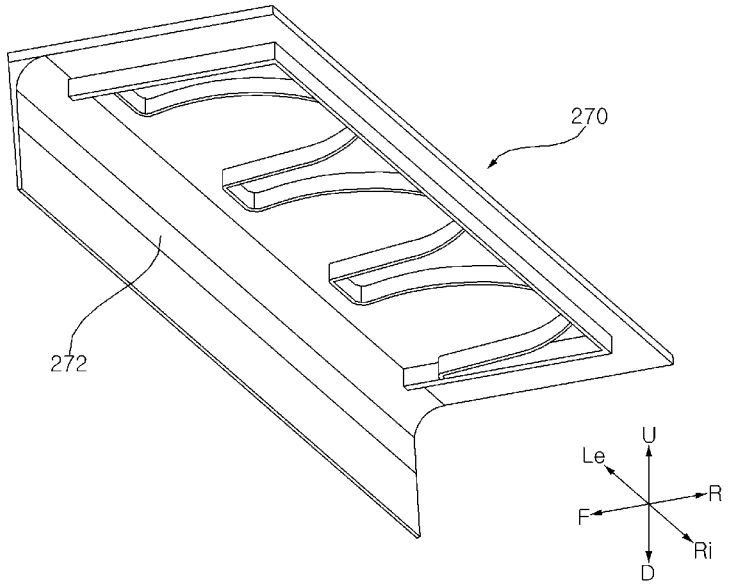
FIG. 26A is a perspective view of a second upper housing according to an embodiment.
Figure 26B:
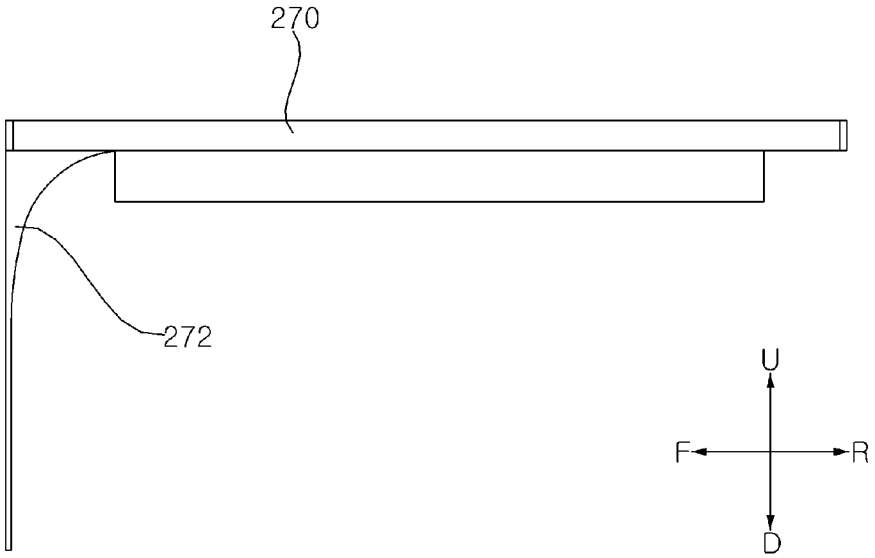
FIG. 26B is a side view of the second upper housing of FIG. 26A.

Referring to FIGS. 26A and 26B, the second upper housing 270 may be mounted to the second upper cover 204. A lower end of the second upper housing 270 may be disposed on the second stepped portion 254 of the second front cover 246. The second upper housing 270 may include a front guide 272 that guides the air flowing through the second fan 280 to the second outlet 202*b*. The front guide 272 may extend downwards from a front end of the second upper housing 270.

Referring to FIG. 24, the front guide 272 causes the air flowing along the second fan 280 to flow downwards. The front guide 272 guides the air flowing through the second fan 280 to the second outlet 202*b*.

The front guide 272 may be disposed so as to be smoothly connected to the second front cover 246. Accordingly, the air flowing along the front guide 272 may flow to the second outlet 202*b* via the second front cover 246.

Figure 27:
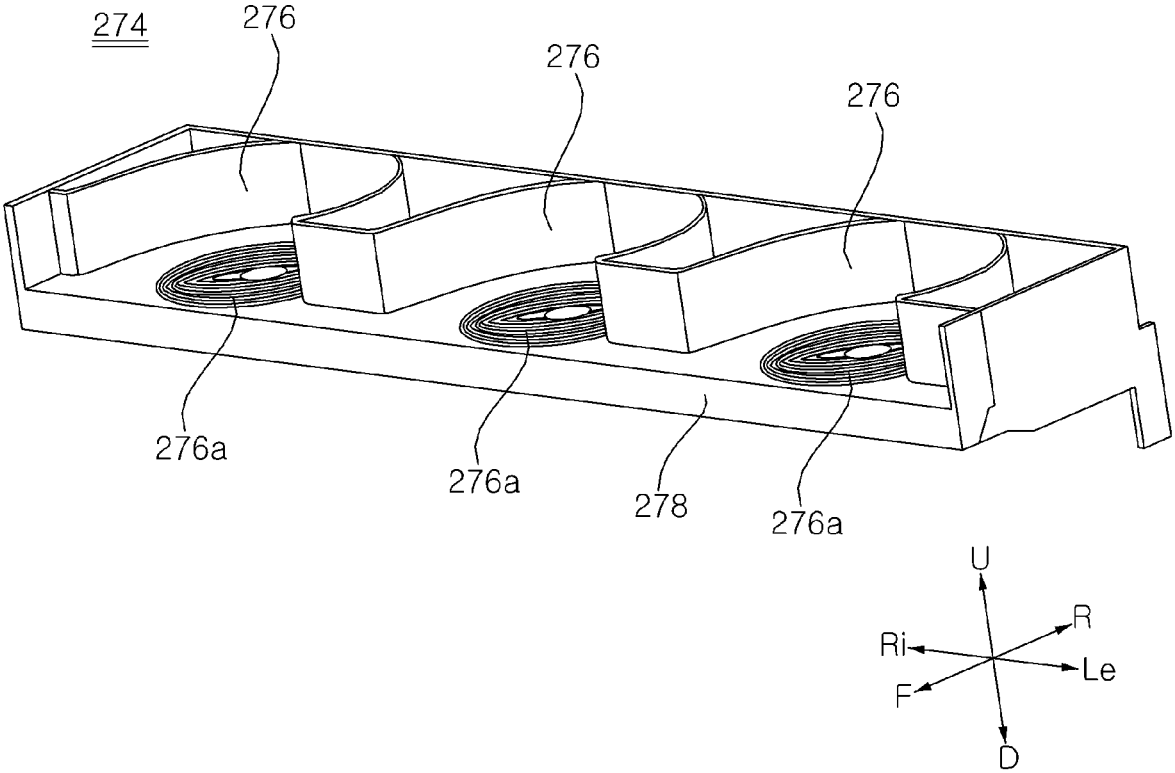
FIG. 27 is a perspective view of a second lower housing according to an embodiment.

Referring to FIG. 24, the second fan motor 280*a* may be mounted in the second upper housing 270. Referring to FIG. 24, the second lower housing 274 may be disposed above the inner cover 266. Referring to FIG. 27, the second lower housing 274 may include a plurality of fan housings 276 that forms spaces in which a plurality of second fans 280 may be disposed. Each of the fan housings 276 may be spaced apart from an outer circumferential surface of the second fan 280 in the radial direction. Each of the fan housings 276 may have an open front portion. Accordingly, the air flowing in the radial direction of the second fan 280 may be discharged to the open front portion of each of the fan housings 276. A fan inlet 276*a*, through which air is introduced into the second fan 280, may be formed below each of the fan housings 276.

The second lower housing 274 may be spaced upwards apart from the inner cover 266. Accordingly, a suction flow path 268*a*, through which the air passing through the filter device 284 flows, may be formed between the second lower housing 274 and the inner cover 266.

The second lower housing 274 may be spaced rearwards apart from the front guide 272 of the second upper housing 270. The second lower housing 274 may include a rear guide 278, which may be spaced apart from the front guide 272 and extends downwards. The second lower housing 274 may be spaced upwards apart from the inner cover 266 by the rear guide 278. The rear guide 278 forms a second discharge flow path 268*b* in the upward-downward direction together with the front guide 272. The front guide 272 and the rear guide 278 may guide the air flowing from the second fan 180 to the second outlet 202*b*.

The filter device 284 may be mounted to the filter-mount 234. The filter-mount 234 may be movably disposed in the second case 202. The filter device 284 and the filter-mount 234 may be coupled to each other by means of a first magnet 287 disposed in the filter device 284 and a second magnet 238 disposed in the filter-mount 234. Accordingly, a position of the filter device 284 may be changed in the upward-downward direction according to movement of the filter-mount 234. Also, a user may easily separate the filter device 284 from the filter-mount 234.

Figure 28:
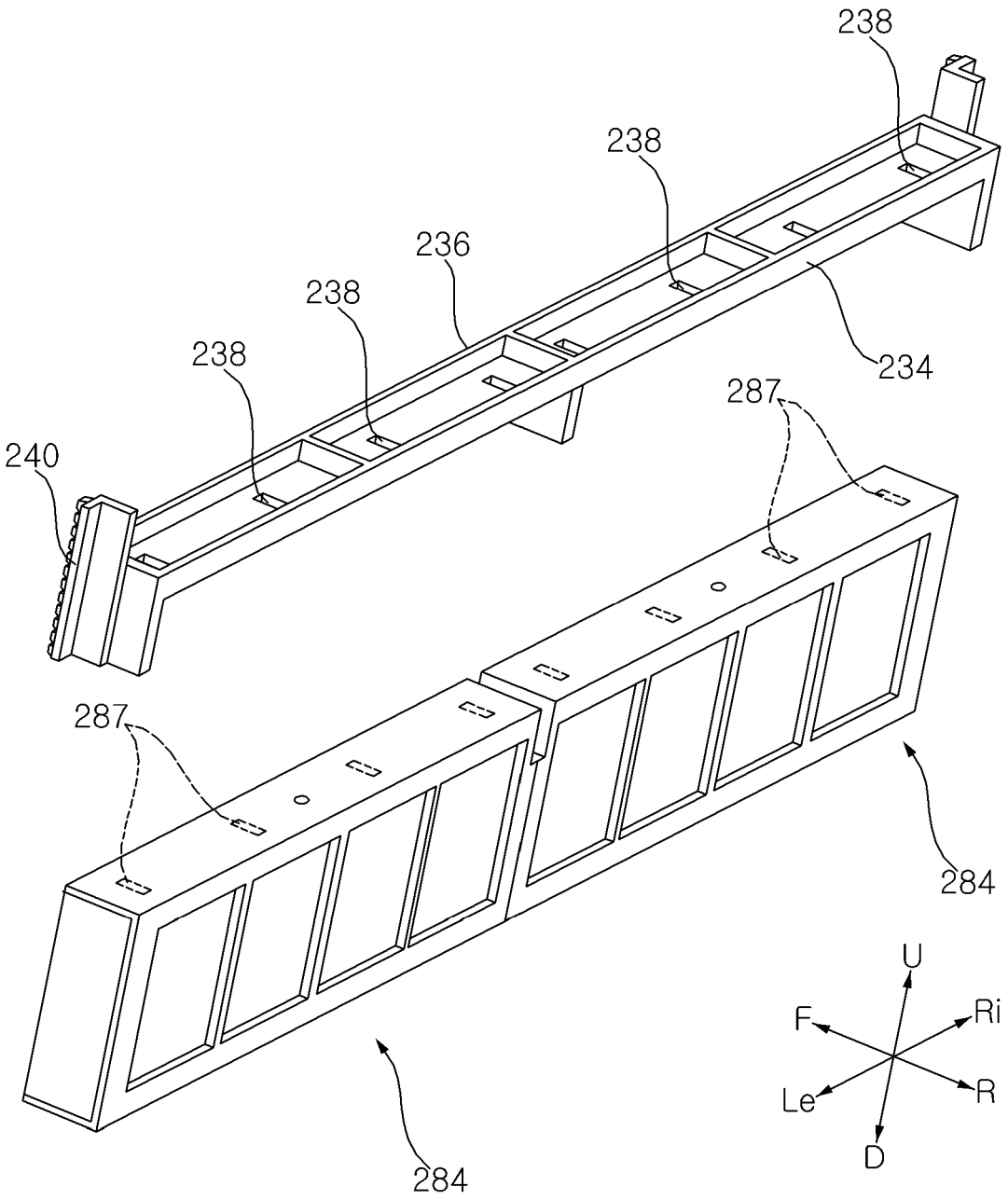
FIG. 28 is an exploded perspective view of a filter-mount and a filter device according to an embodiment.
Figure 29:
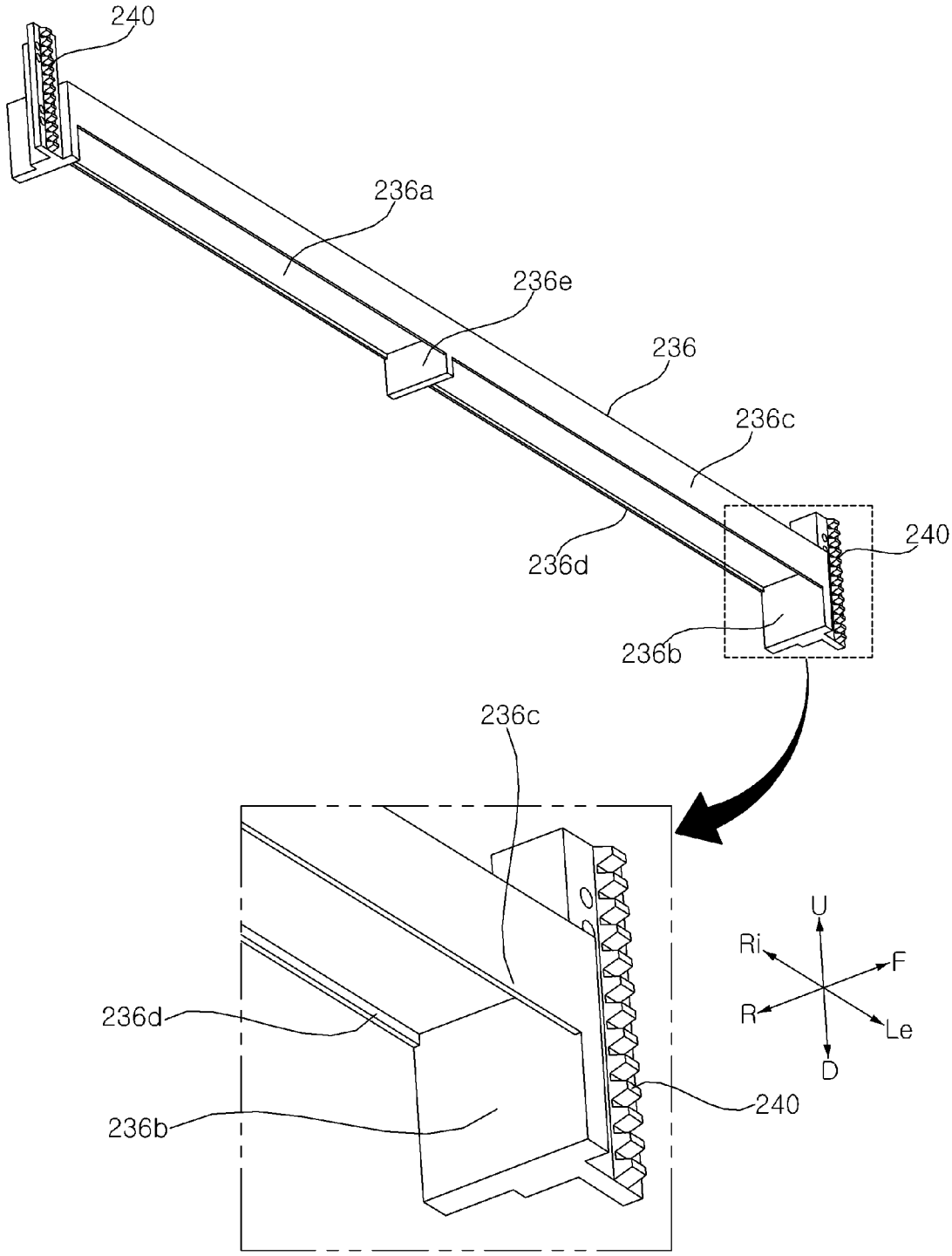
FIG. 29 is a bottom perspective view of a filter-mount according to an embodiment.

Referring to FIGS. 28 and 29, the filter-mount 234 may include a mounting body 236, to which the filter device 284 may be mounted, and a body gear 240 that adjusts a position of the mounting body 236.

Referring to FIGS. 28 and 29, the mounting body 236 may include an upper body 236*a*, which is disposed above the filter device 284, side bodies 236*b*, which extend downwards from both ends of the upper body 236*a*, a front body 236*c*, which extends downwards from the front end of the upper body 236*a*, and a rear body 236*d*, which extends downwards from the rear end of the upper body 236*a*. The side bodies 236*b* may extend downwards to be longer than the front body 236*c* or the rear body 236*d*. Two side bodies 236 may be provided at respective ends of the upper body 236*a*. A partition body 236*e* that isolates a plurality of filter devices 284 from each other may be disposed between the two side bodies 236*b*. A length that the front body 236*c* extends downwards from the upper body 236*a* may be longer than a length that the rear body 236*d* extends downwards from the upper body 236*a*. The front body 236*c*, the rear body 236*d*, and the side bodies 236*b* may guide mounting of the filter device 284 to the filter-mount 234.

A body gear 240 may be disposed outside of the side body 236*b*. The body gear 240 may be a rack gear in which threads protruding forwards extend in the upward-downward direction.

A plurality of second magnets 238 may be disposed above the upper body 236*a*.

Figure 30:
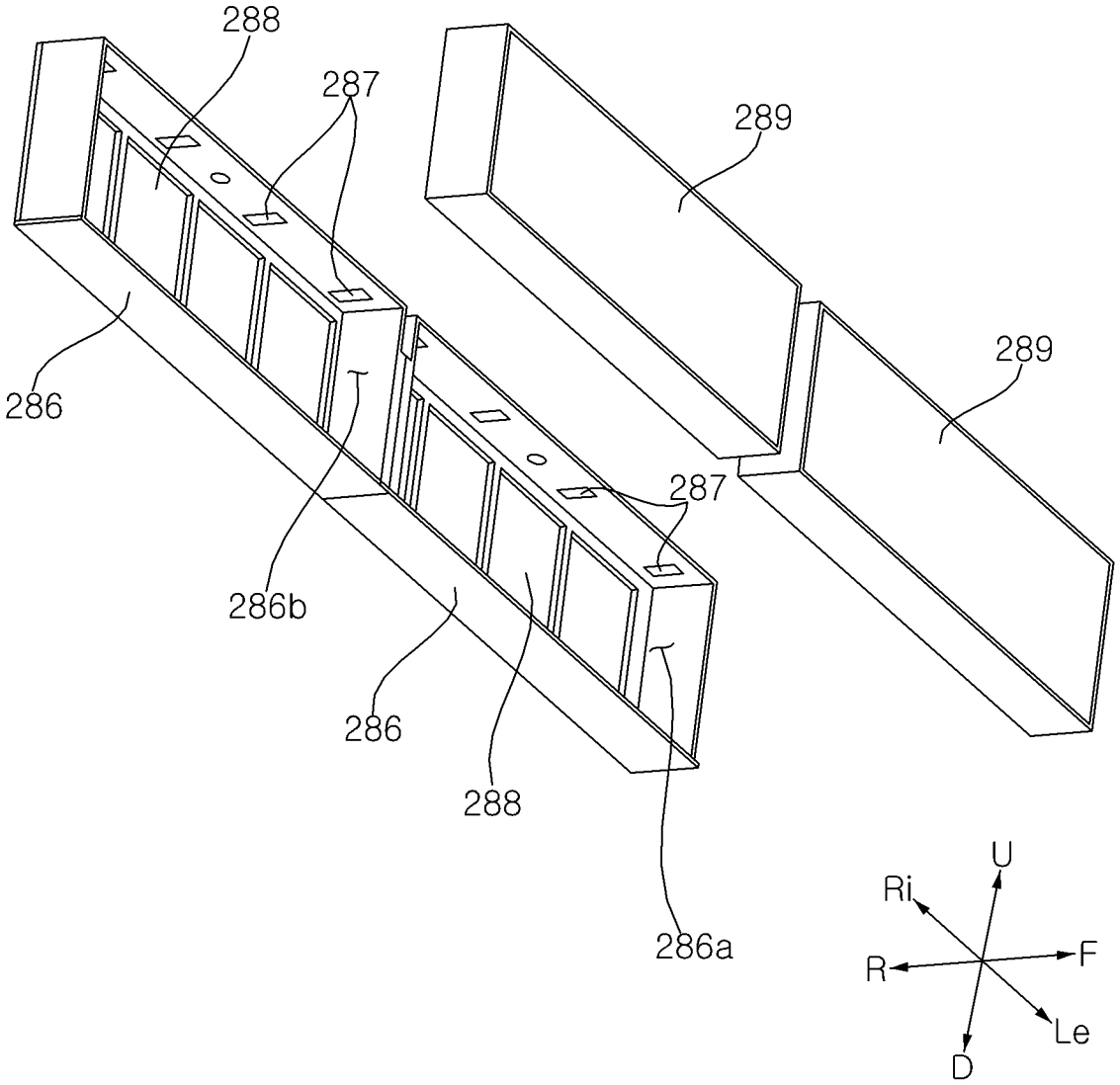
FIG. 30 is an exploded perspective view of a filter device according to an embodiment.

Referring to FIG. 30, the filter device 284 may include a filter case 286, which supports a second pre-filter 288 disposed in one side thereof and has an open opposite side, and a HEPA filter 289, which is disposed so as to be inserted into or withdrawn out of the filter case 286 and functions to remove fine dust. The filter case 286 may have a size capable of accommodating the HEPA filter 289. The second pre-filter 288 that primarily removes foreign substances from the air introduced into the second inlet 202*a* may be disposed in one side of the filter case 286. The filter case 286 may have an opening 286*a* formed in a surface thereof opposite the second pre-filter 288. The HEPA filter 289 may be inserted into or withdrawn out of the filter case 286 through the opening 286*a*.

The first magnet 287 may be disposed on an upper wall of the filter case 286. The first magnet 287 may be disposed at a position corresponding to the second magnet 238 when the filter device 284 is mounted to the filter-mount 234.

Referring to FIG. 33A, the filter-drive device 228 may be disposed on the second lower cover 206, and move the filter-mount 234 in the upward-downward direction. The filter-drive device 228 may be disposed on the second vertical plate 214. The filter-drive device 228 may be disposed at each of both side ends of the second vertical plate 214.

Figure 32:
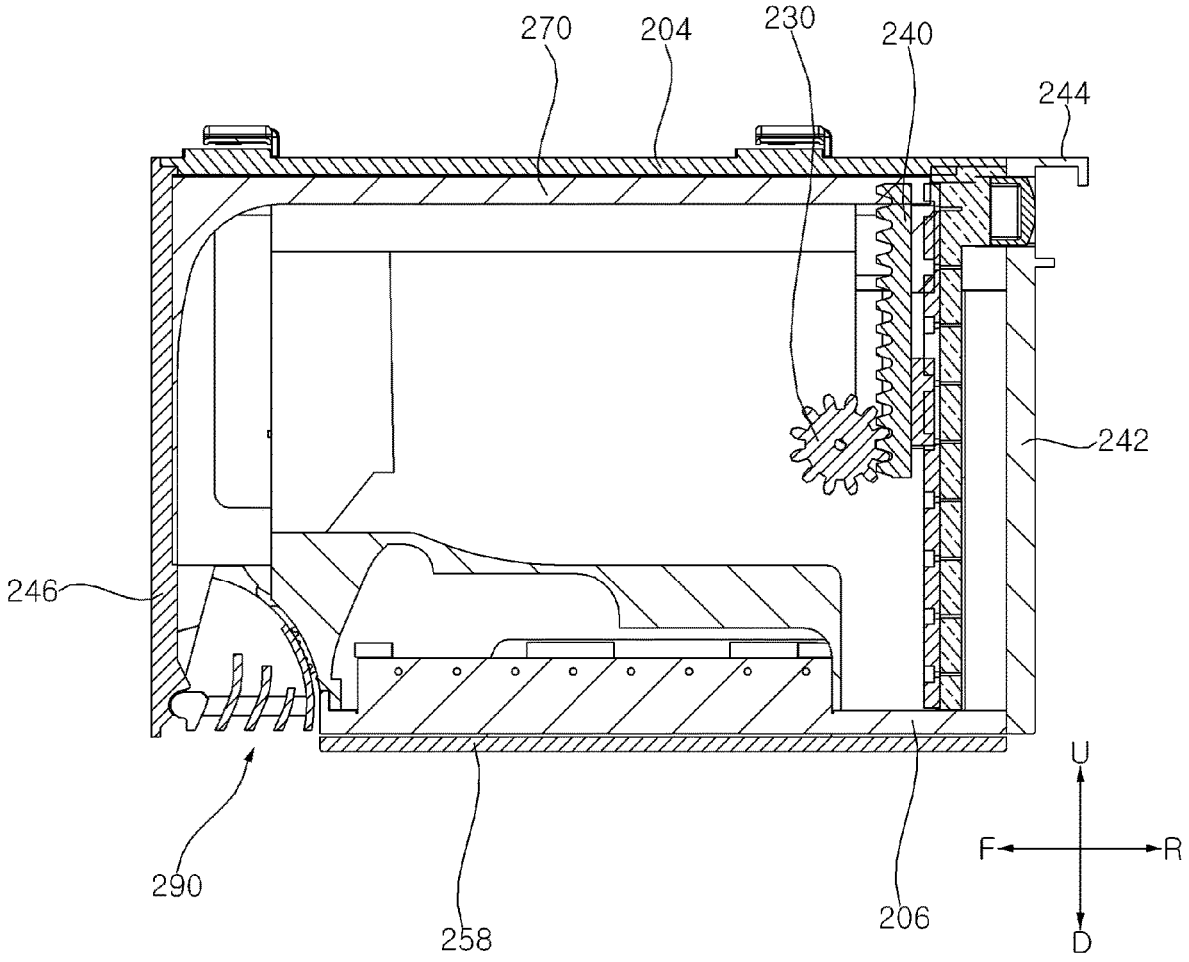
FIG. 32 is a cross-sectional view, taken along line XXXII-XXXII' in FIG. 21.

Referring to FIGS. 32 and 33A, the filter-drive device 228 may include a filter-drive gear 230, which meshes with the body gear 240 and rotates together therewith, and a filter-drive motor 232, which rotates the filter-drive gear 230. The filter-drive gear 230 may be implemented as, for example, a spur gear. The filter-drive gear 230 and the filter-drive motor 232 may be fixedly disposed on the second vertical plate 214.

The second air-processing apparatus 200 may include second louver 250, which is rotatably disposed in the second outlet 202*b* in order to adjust a direction of air that is discharged from the second outlet 202*b*, and a second louver actuator 294, which adjusts an orientation of the second louver 290.

The second louver 290 and the second louver actuator 294 may have the same structures and perform the same functions as the first louver 150 and the first louver actuator 174 of the first air-processing apparatus 100 described above. Therefore, the description of the first louver 150 and the first louver actuator 174 of the first air-processing apparatus 100 may apply to the second louver 290 and the second louver actuator 294.

Hereinafter, movement of the second bottom cover 258, the filter-mount 234, and the filter device 284 will be described with reference to FIGS. 33A to 35C.

Referring to FIGS. 33A and 33B, the second bottom cover 258 is disposed below the filter device 284. Accordingly, a lower side of the second louver 270 may be opened, and thus, the orientation of the second louver 270 may be changed. The filter device 284 and the filter-mount 234 that moves the filter device 284 are disposed above the second bottom cover 258.

Figure 34A:
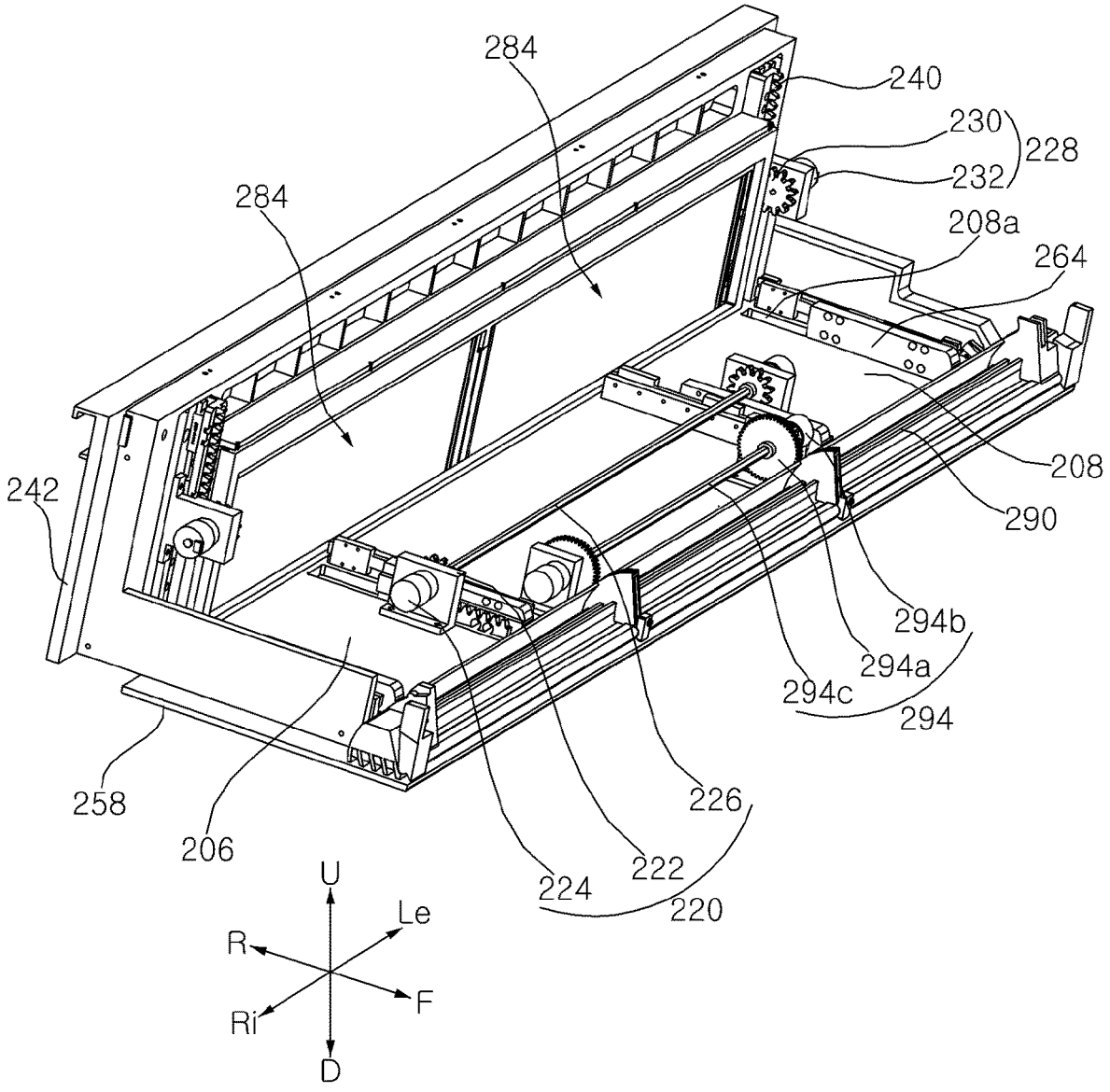
FIG. 34A is a perspective view for explaining the arrangement of the second bottom cover, the filter-mount, and the filter device in the state in which the second bottom cover is located at a front position.
Figure 34B:
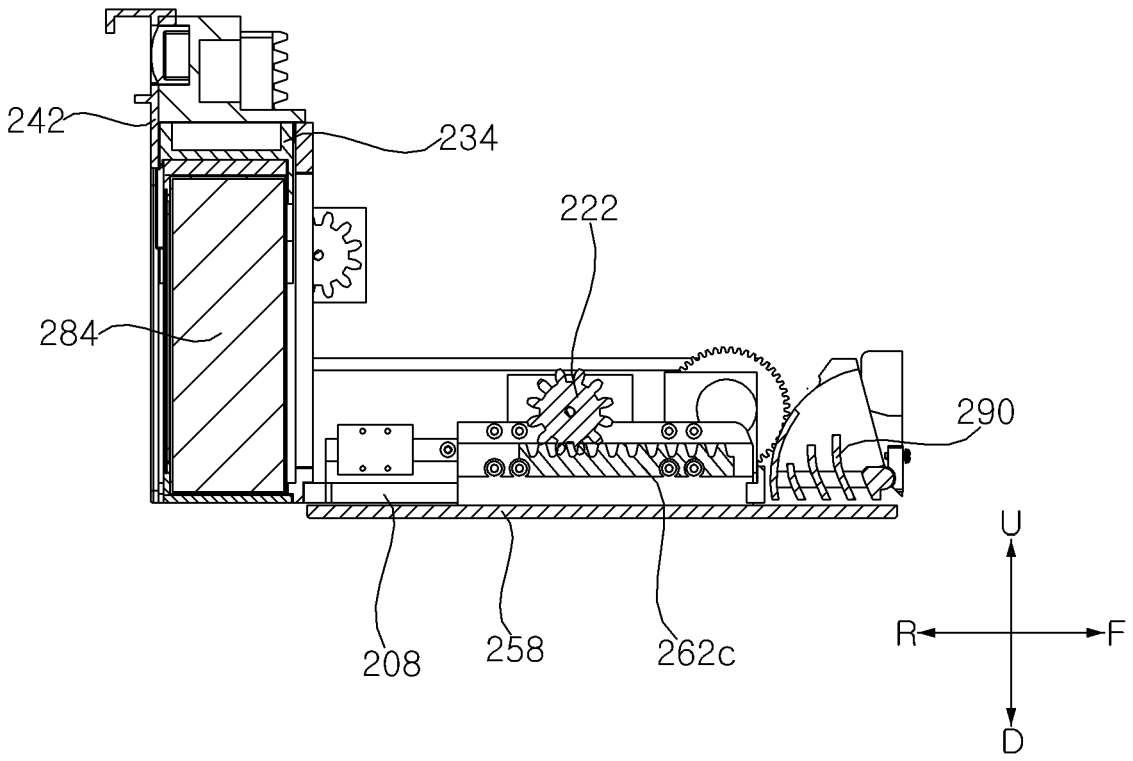
FIG. 34B is a cross-sectional view of the arrangement of FIG. 34A.

Referring to FIGS. 34A and 34B, the second bottom cover 258 may be moved forwards, and may be disposed below the second outlet 202*b*. The second bottom cover 258 may be moved forwards by the operation of the cover-drive device 220.

Referring to FIG. 34B, when the second bottom cover 258 is moved forwards, a region below the filter device 284 is opened. Referring to FIG. 34B, when the second bottom cover 258 is moved forwards, a lower side of the second outlet 202*b* is blocked. Accordingly, rotation of the second louver 270 is restricted.

Figure 35A:
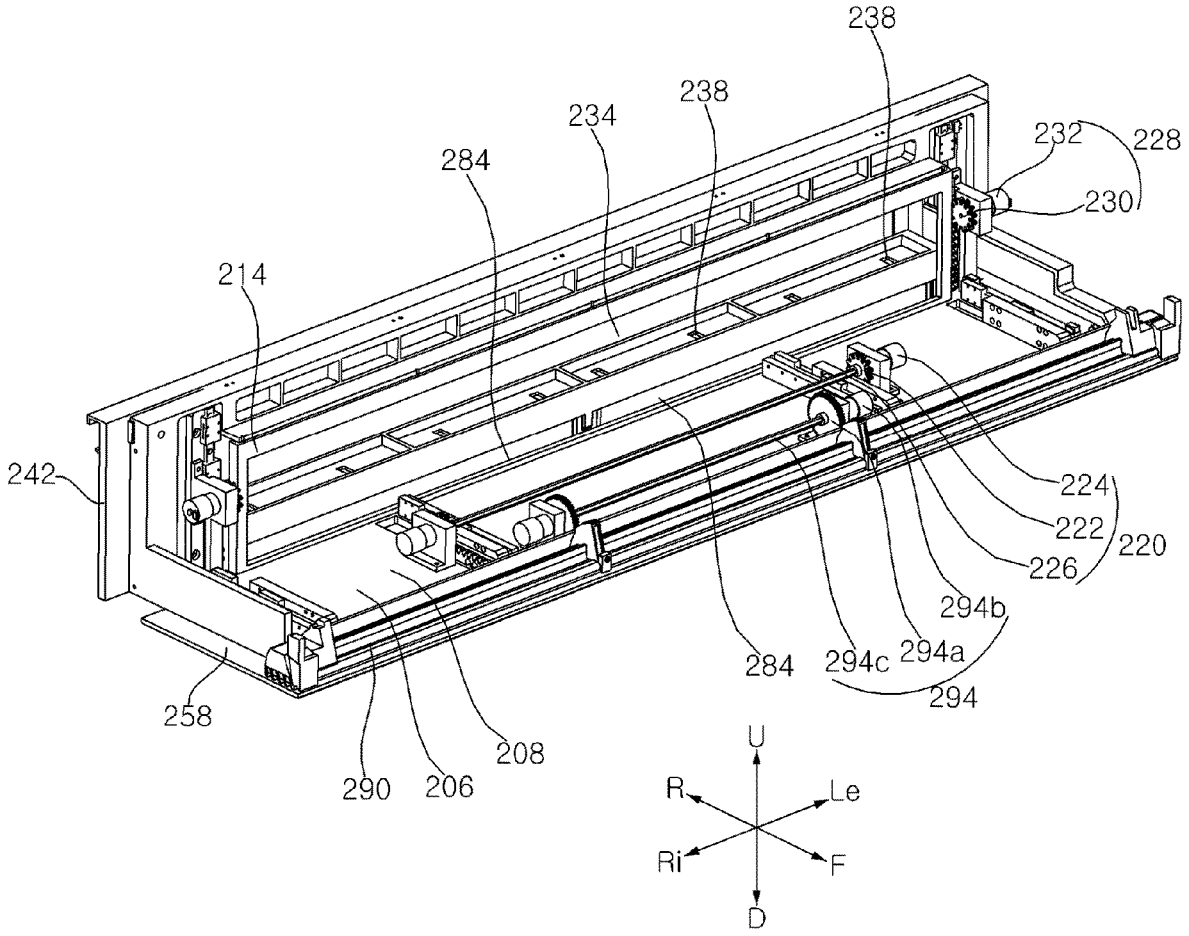
FIG. 35A is a perspective view for explaining the arrangement of the second bottom cover, the filter-mount, and the filter device in the state in which the second bottom cover is located at a front position and the filter-mount is moved downwards.
Figure 35B:
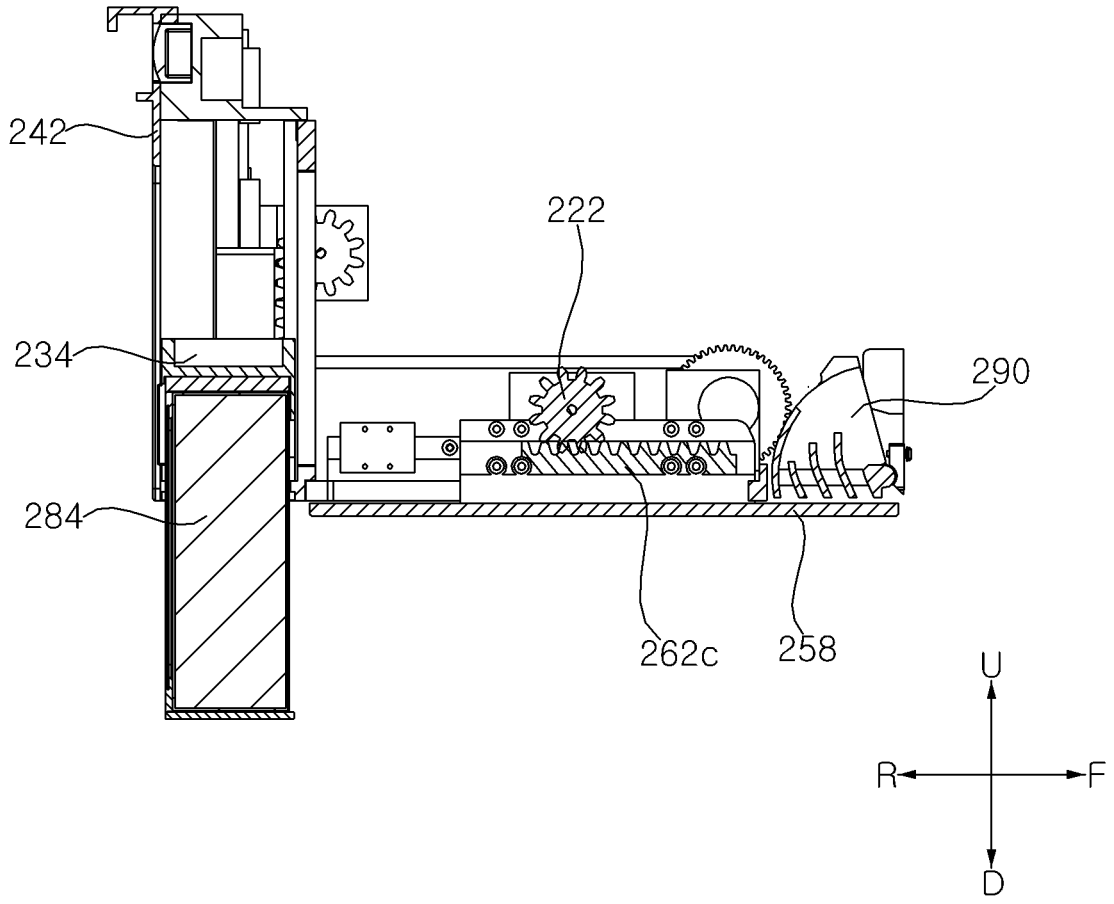
FIG. 35B is a cross-sectional view of the arrangement of FIG. 35A.
Figure 35C:
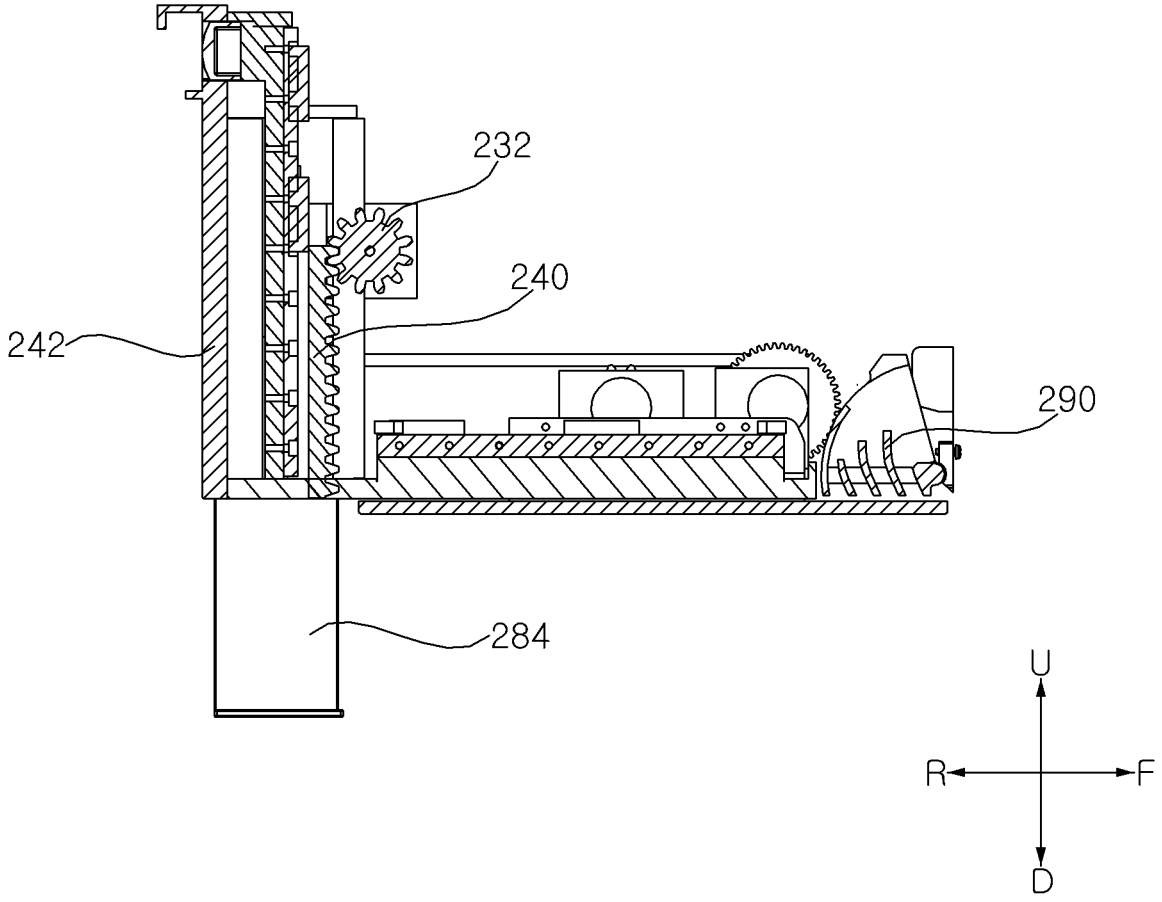
FIG. 35C is a cross-sectional view of the arrangement of FIG. 35A when viewed from a direction different from that of FIG. 35A.

Referring to FIGS. 35A to 35C, in a state in which the second bottom cover 258 is moved forwards, the filter device 284 and the filter-mount 234 may be moved downwards. The filter-mount 234 may be moved downwards by the filter-drive device 228.

The coupled state of the filter-mount 234 and the filter device 284 may be maintained by the first magnet 287 and the second magnet 238. Accordingly, when the filter-mount 234 is moved downwards, the filter device 284 is also moved downwards. When the filter device 284 is moved downwards by the filter-mount 234, a user may easily separate the filter device 284 from the filter-mount 234.

As is apparent from the above description, the air-conditioning system according to embodiments disclosed herein has one or more of the following advantages.

First, as an air-processing apparatus for discharging heat-exchanged air and an air-processing apparatus for discharging purified air are arranged in series in the lateral direction, it is possible to simultaneously perform air purification and temperature control in an indoor space.

Second, as the first air-processing apparatus and the second air-processing apparatus are arranged in the lateral direction and louvers disposed in outlets of the first and second air-processing apparatuses are individually operated, it is possible to individually adjust directions of air discharged therefrom in consideration of the temperature of air that is discharged, thereby promoting air circulation in an indoor space.

Third, as the louver actuator that drives the louver is disposed outside in the radial direction of the rotational shaft of the louver, a size of the louver may increase in the lateral direction. Accordingly, it is possible to secure a size of the outlet in the lateral direction to a maximum extent. Accordingly, the amount of air discharged from the air-processing apparatus may be maximized, and thus, the air in the indoor space may be rapidly processed.

Fourth, as the outer vane has an arc shape and is spaced apart from the louver rotational shaft, a range within which the outer vane may protrude outside of the outlet or may move inside of the outlet may increase, thereby increasing an angular range within which air is discharged.

Fifth, the louver has a structure including a plurality of vanes and a support panel, and is connected to the louver actuator at the support panel. Accordingly, a rigidity of the louver may increase, and thus, the orientation of the louver may be stably changed.

Sixth, the louver groove, which is formed in the case to receive therein the louver rotational shaft, includes an upper protruding portion and a lower protruding portion that limit rotation of the louver. Accordingly, the rotation of the louver may be stably limited.

Embodiments disclosed herein provide an air-conditioning system capable of simultaneously supplying heat-exchanged air and purified air to an indoor space.

Embodiments disclosed herein provide an air-conditioning system capable of rapidly circulating heat-exchanged air and purified air in an indoor space. Embodiments disclosed herein further provide an air-processing apparatus including a louver and a louver actuator capable of opening an outlet, which is formed in the air-processing device in a lateral direction, to a maximum extent. Embodiments disclosed herein furthermore provide an air-processing apparatus capable of increasing a range within which a direction of air is capable of being adjusted by a louver.

A louver, which extends lengthwise in the lateral direction, may be relatively susceptible to distortion. Thus, embodiments disclosed herein provide an air-processing apparatus including a louver having a stable structure. Also, embodiments disclosed herein provide an air-processing apparatus capable of stably restricting movement of a louver.

Advantages are not limited to the above-described advantages, and other advantages not mentioned herein may be readily understood by those skilled in the art from the following description.

Embodiments disclosed herein provide an air-processing apparatus that may include a case having an outlet formed therein, a louver rotatably disposed in the case and configured to adjust a direction of air flowing through the outlet, and a louver actuator configured to adjust an orientation of the louver. The louver may include a louver rotational shaft and a plurality of vanes disposed so as to be spaced apart from each other in a radial direction based on the louver rotational shaft. The louver actuator may be disposed so as to be in contact with the vane located at an outermost position among the plurality of vanes to change the orientation of the louver. Accordingly, a size of the outlet may be secured in a lateral direction to a maximum extent.

The louver rotational shaft may extend along a rotational center of the louver. The plurality of vanes may include an outer vane spaced outwards apart from the louver rotational shaft in a radial direction and a plurality of inner vanes disposed between the louver rotational shaft and the outer vane so as to be spaced apart from each other in the radial direction. The louver may be connected at an outer circumferential surface of the outer vane to the louver actuator. The louver actuator may be disposed outside of the louver in the radial direction of the louver rotational shaft.

A vane gear may be formed on the outer circumferential surface of the outer vane in a circumferential direction, and the louver actuator may be engaged with the vane gear to rotate the louver. The louver actuator may be disposed outside of the louver in the radial direction of the louver rotational shaft.

The outer vane may have an arc shape that extends in the circumferential direction based on the louver rotational shaft. Accordingly, it is possible to change the orientation of the louver and to change the direction of air that is discharged.

The plurality of inner vanes may be shorter than the outer vane. That is, the outer vane may be larger than the inner vanes in order to change the orientation of the louver and to adjust the direction of air.

Each of the plurality of inner vanes may have a different length from the remaining ones of the plurality of inner vanes. The lengths of the plurality of inner vanes may gradually increase in a direction approaching the louver rotational shaft. That is, the lengths of the plurality of inner vanes may gradually decrease in a direction approaching the outer vane. Accordingly, it is possible to prevent a reduction in size of a flow path between the outer vane and the inner vanes. A distance between the outer vane and each of the plurality of inner vanes may gradually increase from above to below.

Each of the plurality of inner vanes may include a lower inner vane portion formed to be inclined so as to be gradually closer to the louver rotational shaft in a downward direction and an upper inner vane portion formed to be bent and extend upwards from the upper end of the lower inner vane portion. This structure is determined in consideration of the direction in which the lower inner vane portion that guides air that is discharged is oriented according to a change in the orientation of the louver.

The louver may include an axial vane that extends from the louver rotational shaft, and the axial vane may extend in a direction parallel to the lower inner vane portion. Accordingly, it is possible to effectively guide the direction of air that flows along the louver rotational shaft.

The louver may include a pair of end panels disposed at both ends of the plurality of vanes in a direction perpendicular to the plurality of vanes and a support panel disposed between the pair of end panels and provided at one side thereof with a vane gear. The vane gear may be engaged with the louver actuator. Accordingly, the plurality of vanes may be stably disposed.

The louver actuator may be spaced apart from the louver rotational shaft in a centrifugal direction, and may be disposed so as to be in contact with an outer circumferential surface of the louver. That is, the louver actuator that rotates the louver may not be disposed on the side surface of the louver, and thus, a size of the louver may increase to left and right surfaces of the outlet.

The louver actuator may include a louver gear configured to be engaged with one side of the louver to rotate the louver and a louver motor configured to rotate the louver gear. The louver actuator may include a pair of louver gears arranged so as to be spaced apart from each other and engaged with one side of the louver to rotate the louver, a gear rotational shaft that interconnects the pair of louver gears, and a louver motor connected to the gear rotational shaft to rotate the gear rotational shaft. Accordingly, it is possible to easily rotate the louver, which extends lengthwise in the lateral direction.

The case may include an upper cover, a lower cover disposed below the upper cover, a rear cover that forms an inlet and supports the filter device mounted thereto, and a front cover disposed so as to be spaced forwards apart from the rear cover. The louver may be rotatably disposed at a lower end of the front cover. Accordingly, it is possible to discharge air in the downward direction or the forward direction of the case.

The front cover may include a louver protrusion having formed therein a louver groove in which the louver rotational shaft is disposed in order to limit a range within which the louver rotates.

The louver protrusion may include an upper protruding portion forming a surface that is inclined from the upper end of the louver groove in a rearward-upward direction and a lower protruding portion forming a surface that is inclined from the lower end of the louver groove in a forward-downward direction. Accordingly, it is possible to limit the rotation of the louver in both directions.

Other advantages will be obvious from the description and the drawings.

Advantages are not limited to the above-described advantages, and other advantages not mentioned herein may be clearly understood by those skilled in the art from the accompanying claims.

Although embodiments have been described with reference to specific embodiments shown in the drawings, it will be apparent to those skilled in the art that the embodiments are not limited to those exemplary embodiments and may be embodied in many forms without departing from the scope, which is set forth in the following claims. These modifications should not be understood separately from the technical spirit or scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air-processing apparatus, comprising:

a case having an outlet formed therein;

a louver assembly rotatably disposed in the case, the louver assembly being configured to adjust a direction of air flowing through the outlet; and a louver actuator configured to adjust an orientation of the louver assembly, wherein the louver assembly comprises a louver rotational shaft and a plurality of vanes spaced apart from each other in a radial direction based on the louver rotational shaft, and wherein the louver rotational shaft extends along a rotational center of the louver assembly, wherein the plurality of vanes comprises:

an outer vane spaced outwards apart from the louver rotational shaft in the radial direction; and a plurality of inner vanes disposed between the louver rotational shaft and the outer vane so as to be spaced apart from each other in the radial direction, wherein a vane gear is formed on the outer circumferential surface of the outer vane in a circumferential direction, and wherein the louver actuator is engaged with the vane gear to rotate the louver assembly.

2. The air-processing apparatus according to claim 1, wherein the louver assembly is connected at an outer circumferential surface of the outer vane to the louver actuator.

3. The air-processing apparatus according to claim 2, wherein the outer vane has an arc shape that extends in a circumferential direction based on the louver rotational shaft.

4. The air-processing apparatus according to claim 2, wherein the plurality of inner vanes is shorter than the outer vane.

5. The air-processing apparatus according to claim 2, wherein each of the plurality of inner vanes has a different length from remaining ones of the plurality of inner vanes.

6. The air-processing apparatus according to claim 2, wherein lengths of the plurality of inner vanes gradually increase in a direction approaching the louver rotational shaft.

7. The air-processing apparatus according to claim 2, wherein a distance between the outer vane and each of the plurality of inner vanes gradually increases in a downward direction.

8. The air-processing apparatus according to claim 2, wherein each of the plurality of inner vanes comprises:

a lower inner vane portion inclined so as to be gradually closer to the louver rotational shaft in a downward direction; and an upper inner vane portion bent and extending upwards from an upper end of the lower inner vane portion.

9. The air-processing apparatus according to claim 2, wherein the louver assembly comprises an axial vane that extends from the louver rotational shaft, and wherein the axial vane extends in a direction parallel to the lower inner vane portion.

10. The air-processing apparatus according to claim 1, wherein the louver assembly comprises:

a pair of end panels disposed at both ends of the plurality of vanes in a direction perpendicular to the plurality of vanes; and a support panel disposed between the pair of end panels, the support panel being provided at one side thereof with a vane gear, and wherein the vane gear is engaged with the louver actuator.

11. The air-processing apparatus according to claim 1, wherein the louver actuator is spaced apart from the louver rotational shaft in a centrifugal direction, and is disposed so as to be in contact with an outer circumferential surface of the louver assembly.

12. The air-processing apparatus according to claim 1, wherein the louver actuator comprises:

a louver gear configured to be engaged with one side of the louver assembly to rotate the louver assembly; and a louver motor configured to rotate the louver gear.

13. The air-processing apparatus according to claim 1, wherein the louver actuator comprises:

a pair of louver gears spaced apart from each other, the pair of louver gears being engaged with one side of the louver assembly to rotate the louver assembly;

a gear rotational shaft that interconnects the pair of louver gears; and a louver motor connected to the gear rotational shaft to rotate the gear rotational shaft.

14. The air-processing apparatus according to claim 1, wherein the case comprises:

an upper cover;

a lower cover disposed below the upper cover;

a rear cover that forms an inlet, the rear cover supporting a filter device mounted thereto; and a front cover spaced forwards apart from the rear cover, and wherein the louver assembly is rotatably disposed at a lower end of the front cover.

15. The air-processing apparatus according to claim 14, wherein the front cover includes a louver protrusion having formed therein a louver groove in which the louver rotational shaft is disposed in order to limit a range within which the louver assembly rotates.

16. The air-processing apparatus according to claim 15, wherein the louver protrusion comprises:

an upper protruding portion forming a surface that is inclined from an upper end of the louver groove in a rearward-upward direction; and a lower protruding portion forming a surface that is inclined from a lower end of the louver groove in a forward-downward direction.

* * * * *